US006028577A

United States Patent [19]

Sakamoto

[11] Patent Number: 6,028,577

[45] Date of Patent: Feb. 22, 2000

[54] ACTIVE-MATRIX TYPE LIQUID-CRYSTAL DISPLAY

[75] Inventor: Michiaki Sakamoto, Tokyo, Japan

[73] Assignee: NEC Corporation, Tokyo, Japan

[21] Appl. No.: 09/012,054

[22] Filed: Jan. 22, 1998

[30] Foreign Application Priority Data

Jan. 24, 1997 [JP] Japan ..... 9-011077

[51] Int. Cl.[7] ..... G09G 3/36

[52] U.S. Cl. ..... 345/92; 345/94

[58] Field of Search ..... 345/94, 95, 96, 345/98, 100, 90, 92

[56] References Cited

U.S. PATENT DOCUMENTS

| | | | |
|---|---|---|---|
| 5,708,485 | 1/1998 | Sato et al. | 349/42 |
| 5,712,652 | 1/1998 | Sato et al. | 345/90 |
| 5,796,378 | 8/1998 | Yoshida et al. | 345/88 |
| 5,923,320 | 7/1999 | Murakami et al. | 345/179 |

FOREIGN PATENT DOCUMENTS

| | | | |
|---|---|---|---|
| 63-202792 | 8/1988 | Japan | G09F 9/30 |
| 63-244877 | 10/1988 | Japan | H01L 27/10 |
| 338689 | 2/1991 | Japan | G09G 3/36 |
| 4280677 | 10/1992 | Japan | H01L 27/146 |
| 5265045 | 10/1993 | Japan | G02F 1/136 |
| 6-67210 | 3/1994 | Japan | G02F 1/136 |
| 6-148680 | 5/1994 | Japan | G02F 1/136 |
| 6-163581 | 6/1994 | Japan | H01L 21/336 |
| 6148680 | 5/1995 | Japan | G02F 1/136 |

*Primary Examiner*—Amare Mengistu
*Assistant Examiner*—Vanel Frenel
*Attorney, Agent, or Firm*—Hayes Soloway Hennessey Grossman & Hage, PC

[57] ABSTRACT

An LCD is provided, which solves the problem about brightness unevenness while suppressing the fabrication cost of a data driver circuit. This LCD is comprised of a first plurality of fixed-potential electrodes and a second plurality of fixed-potential electrodes. Each of the first plurality of fixed-potential electrodes is located between one of the first plurality of pixel electrodes and a corresponding one of the second pluralities of pixel electrodes that form one of the electrode pairs. Each of the second plurality of fixed-potential electrodes is located between one of the first plurality of pixel electrodes and an adjoining one of the second plurality of pixel electrodes that are included in different ones of the electrode pairs. The first and second pluralities of fixed-potential electrodes are designed to be applied with a fixed electric potential on operation.

6 Claims, 18 Drawing Sheets

ACTIVE-MATRIX TYPE LIQUID-CRYSTAL DISPLAY

BACKGROUND OF THE INVENTION

1. Field of the Invention

The present invention relates to a Liquid-Crystal Display (LCD) and more particularly, to an active-matrix type LCD having a plurality of Thin-Film Transistors (TFTS) arranged in a matrix array.

2. Description of the Prior Art

In recent years, active-matrix type color LCDs have been widely used as electronic display devices for personal computers, portable televisions, or the like, because they are low in power dissipation, thin, light-weight, and good in image quality. A typical example of the configuration of these LCDs is shown in FIG. 1.

As shown in FIG. 1, this color LCD is comprised of pixel electrodes 101 arranged in a matrix array with m rows and 3n columns, where m and n are natural numbers. Therefore, the total number of the pixel electrodes 101 is (m×3n).

A group of the (m×n) pixel electrodes 101 are used for displaying the red (R) color, forming R subpixels. Another group of the (m×n) pixel electrodes 101 are used for displaying the green (G) color, forming G subpixels. The remaining (m×n) pixel electrodes 101 are used for displaying the blue (B) color, forming B subpixels. Thus, the total number of pixels or dots of this color LCD is (m×n).

First to m-th scanning lines or electrodes 102(1) to 102(m) are arranged along the respective rows of the matrix array. First to 3n-th data lines or electrodes 103(1) to 103(3n) are arranged along the respective columns of the matrix array. (M×3n) TFTs 106 are arranged at the respective intersections of the scanning lines 102(1) to 102(m) and the data lines 103(1) to 103(3n), driving the respective (m×3n) pixel electrodes 101.

The scanning lines 102(1) to 102(m) are driven or controlled by a scanner driver circuit 104. The data lines 103(1) to 103(3n) are driven or controlled by a data driver circuit 105.

Each of the (m×3n) TFTs 106 has a gate electrically connected to a corresponding one of the scanning lines 102(1) to 102(m), a drain electrically connected to a corresponding one of the data lines 103(1) to 102(3n), and a source electrically connected to a corresponding one of the (m×3n) pixel electrodes 101.

For example, if the conventional LCD with the configuration shown in FIG. 1 has a resolution of (640×480) pixels or dots according to the Video Graphics Array (VGA) standard, the number of the scanning lines is 480, the number of the data lines is 1920 (=640×3), and the number of the pixel electrodes 101 is 1920 (=640×3).

Typically, the data driver circuit 105 needs to produce output voltages with more than two levels (e.g., 6 levels or more) to the data lines 103(1) to 103(3n) in order to display a required color image. On the other hand, it is sufficient for the scanner driver circuit 104 to produce output voltages with only two levels (i.e., high and low levels) to the scanning lines 102(1) to 102(m) in order to scan these lines 102(1) to 102(m). Therefore, the data driver circuit 105 is more expensive compared with the scanner driver circuit 104, resulting in a problem that the color LCD is high in fabrication cost.

To solve this problem, an improved configuration of the active-matrlx type color LCDs is shown in FIG. 2. This configuration is disclosed in, for example, the Japanese Non-Examined Patent Publication Nos. 3-38689 published in February 1991, 5-265045 published in October 1993, and 6-148680 published in May 1994.

As shown in FIG. 2, a plurality of pixel electrodes 201 are arranged in a matrix array with 2m rows and (3/2)n columns. The total number of these pixel electrodes 201 is 3(m×n).

A group of the [(2/3)m×(1/2)n] pixel electrodes 201 are used for displaying the red (R) color, forming R subpixels. Another group of the [(2/3)m×(1/2)n] pixel electrodes 201 are used for displaying the green (G) color, forming G subpixels. The remaining [(2/3)m×(1/2)n] pixel electrodes 201 are used for displaying the blue (B) color, forming B subpixels. Thus, the total number of pixels or dots of this color LCD is (m×n) (=3[(2/3)m×(1/2)n]).

First to 2m-th scanning lines 202(1) to 202(2m) are arranged along the respective rows of the matrix array. First to (3/2)n-th data lines 203(1) to 203(3n/2) are arranged along the respective columns of the matrix array. 3(m×n) TFTs 206 are arranged at the respective intersections of the scanning lines 202(1) to 202(2m) and the data lines 203(1) to 203(3n/2).

The scanning lines 202(1) to 202(2m) are driven by a scanner driver circuit 204. The data lines 203(1) to 203(3n/2) are driven by a data driver circuit 205.

The electrical connection of the TFTs 206 to the scanning lines 202(1) to 202(2m), the data lines 203(1) to 203(3n/2), and the pixel electrodes 201 is shown in detail in FIG. 3.

In FIG. 3, a part 200 of the matrix array is Illustrated, which includes the intersections of the (j−1)-th and j-th data lines 203(j−1) and 203(j) with the i-th, (i+1)-th, (i+2)-th, and (i+3)-th scanning lines 202(i), 202(i+1), 202(i+2), and 202(i+3), and their neighborhood. Here, i and j are natural numbers satisfying the relationships of $1 \leqq i \leqq 2m$ and $1 \leqq j \leqq 3n/2$.

The TFT 206(i, j), which is located at the intersection of the i-th scanning line 202(i) and the j-th data line 203(j), has a gate electrically connected to the i-th scanning line 202(i), a drain electrically connected to the j-th data line 203(j), and a source electrically connected to the corresponding pixel electrode 201(i, j). Similarly, the TFT 206(i+1, j), which is located at the intersection of the (i+1)-th scanning line 202(i+1) and the j-th data line 203(j), has a gate electrically connected to the (i+1)-th scanning line 202(i+1), a drain electrically connected to the j-th data line 203(j), and a source electrically connected to the corresponding pixel electrode 201(i+1, j). Thus, the j-th data line 203(j) Is commonly used by the two TFTs 206(i, j) and 206(i+1, j). The i-th and (i+1)-th scanning lines 202(i) and 202(i+1) are respectively used by these two TFTs 206(i, j) and 206(i+1, j).

The TFT 206(i, j−1), which is located at the intersection of the i-th scanning line 202(i) and the (j−1)-th data line 203(j−1). has a gate electrically connected to the i-th scanning line 202(i), a drain electrically connected to the (j−1)-th data line 203(j−1), and a source electrically connected to the corresponding pixel electrode 201(i, j−1). Similarly, the TFT 206(i+1, j−1), which is located at the intersection of the (i+1)-th scanning line 202(i+1) and the (j−1)-tb data line 203(j−1), has a gate electrically connected to the (i+1)-th scanning line 202(i+1), a drain electrically connected to the (j−1)-th data line 203(j−1), and a source electrically connected to the corresponding pixel electrode 201(i+1, j−1). Thus, the (j−1)-th data line 203(j−1) is commonly used by the two TFTs 206(i, j−1) and 206(i+1, j−1). The i-th and (i+1)-th scanning lines 202(i) and 202(i+1) are respectively used by these two TFTs 206(i, j−1) and 206(i+1, j−1), The TFT 206(i+2, j−1), which is located at the intersection of the (i+2)-th scanning line 202(i+2) and the (j−1)-th data line 203(j−1), has a gate electrically connected to the (i+2)-th scanning line 202(i+2), a drain electrically connected to the (j−1)-th data line 203(j−1), and a source electrically connected to the corresponding pixel electrode 201(i+2, j−1). Similarly, the TFT 206(i+3, j−1), which is located at the intersection of the (i+3)-th scanning line 202(i+3) and the (j−1)-th data line 203(j−1), has a gate electrically connected to the (i+3)th scanning line 202(i+3), a drain electrically connected to the (j−1)-th data line 203(j−1), and a source electrically connected to the corresponding pixel electrode 201(i+3, j−1). Thus, the (j−1)-th data line 203(j−1) is commonly used by the two TFTs 206(i+2, j−1) and 206(i+3, j−1). The (i+2)-th and (i+3)-th scanning lines 202(i+2) and 202(i+3) are respectively used by these two TFTs 206(i+2, j−1) and 206(i+3, j−1).

The TFT 206(i+2, j), which is located at the intersection of the (i+2)-th scanning line 202(i+2) and the j-th data line 203(j), has a gate electrically connected to the (i+2)-th scanning line 202(i+2), a drain electrically connected to the j-th data line 203(j), and a source electrically connected to the corresponding pixel electrode 201(i+2, j). Similarly. the TFT 206(i+3, j). which is lodated at the intersection of the (i+3)-th scanning line 202(i+3) and the j-th data line 203(j), has a gate electrically connected to the (i+3)-th scanning line 202(i+3), a drain electrically connected to the j-th data line 203(j), and a source electrically connected to the corresponding pixel electrode 201(i+3, j). Thus, the j-th data line 203(j) is commonly used by the two TFTs 206(i+2, j) and 206(i+3, j). The (i+2)-th and (i+3)-th scanning lines 202(i+2) and 202(i+3) are respectively used by these two TFTs 206(i+2, j) and 206(i+3, j).

As described above, with the improved configuration shown in FIG. 2, two ones of the scanning lines 202(1) to 202(2m) are provided for each row of the matrix array of the pixels and each of the data lines 203(1) to 203(3n/2) is commonly used by two adjoining columns thereof. Accordingly, the number of the necessary scanning lines is 2m and the number of the necessary data lines is (3n/2) for (m×n) color pixels.

For example, if the conventional LCD has a resolution of (640×480) pixels according to the VGA standard. the number of the necessary scanning lines is 960 (=480×2), the number of the necessary data lines is 960 (=640×3/2), and the number of the pixel electrodes is 960 (=640×3/2).

Therefore, with the improved configuration shown in FIGS. 2 and 3, the number of the necessary data lines is decreased to a half of that of the conventional configuration shown in FIG. 1. As a result, the fabrication cost of the data driver circuit is able to be reduced.

Next, a driving method of the conventional LCD with the improved configuration shown in FIGS. 2 and 3 will be explained below with reference to FIGS. 3 and 4A to 4E.

In this driving method, the scanning lines 202(1) to 202(2m) are successively activated from the first scanning line 202(1) to the last or 2m-th scanning line 202(2m). The data lines 203(1) to 203(3n/2) are successively activated from the first data line 203(1) to the last or (3n/2)-th data line 203(3n/2) synchronized with the activation behavior of the scanning lines 202(1) to 202(2m), thereby displaying a required color image. These scanning and data-writing processes are the same as those that have ever been known well.

However, unlike the well-known popular scanning processes, a scanning period for each row of the matrix array is divided into two subperiods, i.e., earlier and later subperiods. For example, in FIG. 3, the pixel electrodes 201(i, j) and 201(i, j−1) electrically connected to the scanning line 202(1) are driven or written during the earlier subperiod. The pixel electrodes 201(i+1, j) and 201(i+1, j−1) electrically connected to the scanning line 202(i+1) are driven during the later subperiod. Similarly, the pixel electrodes 201(i+2, j) and 201(i+2, j−1) electrically connected to the scanning line 202(i+2) are driven during the earlier subperiod. The pixel electrodes 201(i+3, j) and 201(i+3, j−1) electrically connected to the scanning line 202(i+3) are driven during the later subperiod.

Thus, the pixel electrodes 201(i, j), 201(i+1, j), 201(i+2, j), and 201(i+3, j), which are electrically connected in common to the data line 203(j), are successively activated in this order. This means that the activation or driving order is along an arrow y shown in FIG. 3. The pixel electrodes 201(i, j−1), 201(i+1, j−1), 201(i+2, j−1), and 201(i+3, j−1), which are electrically connected in common to the data line 203(j−1), are successively activated in this order along an arrow x shown in FIG. 3.

Because the arrow y is inverted with respect to the arrow x, this driving or activation method is termed the "U-inverted U" type.

The conventional LCD with the improved configuration shown in FIGS. 2 and 3, which is activated by the method of the "U-inverted U" type, has the following problem.

For example, as shown in FIG. 4B, when the i-th scanning line 202(1) is applied with a scanning signal G(i) of a voltage level $V_g$ (in other words, the i-th scanning line 202(i) is activated) during an earlier subperiod TH1 (which starts at the time T1 and ends at the time T2), a data signal D(j) of a high-level voltage $V_m$ is applied to or written in the pixel electrode 201(i, j) through the data line 203(j). Thus, the voltage of the pixel electrode 201(i, j) is turned from a low-level voltage $V_n$ to the high-level voltage $V_m$ at the time T1, and it is kept unchanged during the earlier uubperiod TH1, as shown in FIG. 4D.

Next, when the (i+1)-th scanning line 202(i+1) is applied with a scanning signal G(i+1) of the same voltage level $V_g$ (in other words, the (i+1)-th scanning line 202(i+1) is activated) during a later subperiod TH2 (which starts at the time T2 and ends at the time T3), as shown in FIG. 4C, the data signal D(j) of the low-level voltage $V_n$ is applied to or written in the pixel electrode 201(i+1, j) through the same data line 203(j). Thus, the voltage of the pixel electrode 201(i+1, j) is turned from the high-level voltage $V_m$ to the low-level voltage $V_n$ at the time T2, and it is kept unchanged during the later subperiod TH2, as shown in FIG. 4E.

During the later subperiod TH2, the voltage of the pixel electrode 201(i, j) is lowered from the high-level voltage $V_m$ by a voltage deviation $V_{pp}$, resulting in a problem that the display quality of the LCD is degraded. This problem is due to a parasitic capacitor C1 between the two adjoining pixel electrodes 201(i, j) and 201(i+1, j) which are located at each side of the corresponding data line 203(j).

The voltage deviation $V_{pp}$ can be expressed as $$V_{pp}=(C_1/C_{tot})\cdot\Delta V_p \quad (1)$$

where $C_1$ is the capacitance per unit length of the parasitic capacitor C1, $C_{tot}$ is the total capacitance per unit length of each pixel electrode, and $\Delta V_p$ is the voltage amplitude (i.e., $V_m-V_n$) of each pixel electrode.

Computer simulation was carried out by the inventor based on the equation (1), presenting the results shown in FIG. 19. The curve A in FIG. 19 indicates the case where a data line exists between two adjoining pixel electrodes, and the curve B indicates the case where no data line exists therebetween.

When the distance L between the opposite ends of the adjoining pixel electrodes is 7 $\mu$m, it is seen from the curve A in FIG. 19 that the parasitic capacitance $C_1$ is 10 pF/m. If the pitch of the pixel electrodes is 300 $\mu$m, the parasitic capacitance $C_1$ is expressed as $$C_1=10(\text{pF/m})\times 300\ \mu\text{m}=0.003\ \text{pF}.$$

If the total capacitance of each pixel electrode $C_{tot}$ is 0.1 pF, and the voltage amplitude $\Delta V_p$ of each pixel electrode is 5 V for displaying a medium gradation, the voltage deviation $V_{pp}$ is expressed as $$V_{pp}=[(0.03)/0.1]\times 5=0.15\ \text{V}=150\ \text{mV} \quad (2)$$

The expression (2) represents the brightness difference is distinctive for displaying the medium gradation. This means that distinctive brightness difference exists between the pixel electrode 201(i, j) in which the high-level voltage $V_m$ is written during the earlier subperiod TH1 and the pixel electrode 201(i+1, j) in which the high-level voltage $V_m$ is written during the later subperiod TH2.

As a result, when some specified patterns such as a check pattern are displayed on the screen of this LCD, the displayed image includes some defects such as vertical-striped brightness unevenness. This is due to the layout that the pixel electrodes written during the earlier subperiod TH1 and those written during the later subperiod TH2 are vertically aligned along the data lines.

A variation of the above conventional LCD with the improved configuration shown in FIGS. 2 and 3 will be explained below with reference to FIGS. 5 and 6A to 6G. This configuration makes it possible to suppress the above-described defects in the displayed image.

FIG. 5 shows the electrical connection or layout of the pixel electrodes and the TFTs to the scanning and data lines.

In FIG. 5, the positions of the TFTs 206(i, j), 206(i+1, j), 206(i+2, j), and 206(i+3, j) located at the right-hand side are the same as those in FIG. 3. However, the position of the TFT 206(i, j−1) in FIG. 5 is opposite to that of the TFT 206(i+1, j−1), and the position of the TFT 206(i+2, j−1) in FIG. 5 is opposite to that of the TFT 206(i+3, j−1).

A driving method of the conventional LCD with the improved configuration shown in FIG. 5 will be explained below with reference to FIGS. 6A to 6G.

In FIG. 5, the pixel electrodes 201(i, j) and 201(i, j−1) electrically connected to the scanning line 202(i) are driven or written during the earlier subperiod. The pixel electrodes 201(i+1, j) and 201(i+1, j−1) electrically connected to the scanning line 202(i+1) are driven during the later subperiod. Similarly, the pixel electrodes 201(i+2, j) and 201(i+2, j−1) electrically connected to the scanning line 202(i+2) are driven during the earlier subperiod. The pixel electrodes 201(i+3, j) and 201(i+3, j−1) electrically connected to the scanning line 202(i+3) are driven during the later subperiod.

Thus, similar to the method in FIG. 3, the pixel electrodes 201(i, j), 201(i+1, j), 201(i+2, j), and 201(i+3, j), which are electrically connected in common to the data line 203(j), are successively driven or activated in this order. This means that the driving order is along the same arrow y as that shown in FIG. 3.

Unlike the configuration in FIG. 3, the pixel electrodes 201(i, j−1), 201(i+1, j−1), 201(i+2, j−1), and 201(i+3, j−1), which are electrically connected in common to the data line 203(j−1), are successively driven or activated in this order along an arrow x' shown in FIG. 5. The arrow x' corresponds to a mirrored image of the arrow x in FIG. 3.

Because the arrows x' and y are parallel to each other, this driving or activation method is termed the "U—U" type.

For example, as shown in FIG. 6C, when the i-th scanning line 202(i) is applied with a scanning signal G(i) of a voltage level $V_g$ (in other words, the i-th scanning line 202(i) is activated) during an earlier subperiod TH1, a data signal D(j) of a high-level voltage $V_m$ is applied to or written in the pixel electrode 201(i, j) through the data line 203(j). Thus, the voltage of the pixel electrode 201(i, j) is turned from a low-level voltage $V_n$ to the high-level voltage $V_m$ at the time T1, and it is kept unchanged during the earlier subperiod TH1, as shown in FIG. 6E.

Next, when the (i+1)-th scanning line 202(i+1) is applied with a scanning signal G(i+1) of the same voltage level $V_g$ (in other words, the (i+1)-th scanning line 202(i+1) is activated) during a later subperiod TH2. as shown in FIG. 6D, the data signal D(j) of the low-level voltage $V_n$ is written in the pixel electrode 201(i+1, j) through the same data line 203(j). Thus, the voltage of the pixel electrode 201(i+1, j) is turned from the low-level voltage $V_n$ to the high-level voltage $V_m$ at the time T2, and it is kept unchanged during the later subperiod TH2, as shown in FIG. 6G.

Simultaneously with the application of a scanning signal G(i+1) of the same voltage level $V_g$ to the (i+1)-th scanning line 202(i+1) during the later subperiod TH2, as shown in FIG. 6D, the data signal D(j−1) of the low-level voltage $V_n$ is applied to or written in the pixel electrode 201(i+1, j−1) through the data line 203(j−1). Thus, the voltage of the pixel electrode 201(i+1, j−1) is turned from the high-level voltage $V_m$ to the low-level voltage $V_n$ at the time T2, and it is kept unchanged during the later subperiod TH2, as shown in FIG. 6F.

As described above, during the later subperiod TH2, the voltage of the pixel electrode 201(i, j) is lowered from the high-level voltage $V_m$ by a voltage deviation $V_{pp}$, thereby causing a problem that the display quality of the LCD is degraded. This problem is due to a parasitic capacitance C1 between the two adjoining pixel electrodes 201(i, j) and 201(i+1, j) which are located at each side of the data line 203(j), and another parasitic capacitance C2 between the two adjoining pixel electrodes 201(i, j) and 201(i+1, j−1) which are located between the data lines 203(j−1) and 203(j).

The voltage deviation $V_{pp}$ can be expressed as $$V_{pp}=[(C_1-C_2)/C_{tot}]\cdot\Delta V_p \quad (3)$$

where $C_1$ and $C_2$ are the capacitances per unit length of the parasitic capacitors C1 and C2, $C_{tot}$ is the total capacitance per unit length of each pixel electrode, and $\Delta V_p$ is the voltage amplitude (i.e., $V_m-V_n$) of each pixel electrode. The sign difference between the capacitance $C_1$ and $C_2$ is due to the fact that the data signals D(j) and D(j−1) are in opposite levels.

The above expression (3) means that the capacitances $C_1$ and $C_2$ serve to cancel their effects with each other. However, these two capacitances $C_1$ and $C_2$ are not completely canceled with each other, because they are not equal.

Specifically, the data line 203(j) is located between the pixel electrodes 201(i, j) and 201(i+1, j). Therefore, when the distance L between the opposite ends of the adjoining pixel electrodes 201(i, j) and 201(i+1, j) is 7 $\mu$m, it is seen from the curve A in FIG. 19 that the parasitic capacitance $C_1$ is 10 pF/m. On the other hand, no data line is located between the pixel electrodes 201(i, j) and 201(i+1, j−1) and therefore, the parasitic capacitance $C_2$ is approximately 30 pF/m, which is greater than the parasitic capacitance $C_1$.

Thus, the parasitic capacitances $C_1$ and $C_2$ are not completely canceled with each other.

If the total capacitance of each pixel electrode $C_{tot}$ is 0.1 pF, and the voltage amplitude $\Delta V_p$ of each pixel electrode is 5 V for displaying a medium gradation, the voltage deviation $V_{pp}$ is expressed as $$V_{pp}=\{[(10-30)\times 300]/0.1]\}\times 5=-0.3\ V=-300\ m\ V \quad (4)$$

The expression (4) represents the brightness difference is distinctive for displaying the medium gradation. This means that distinctive brightness difference exists between and the adjoining pixel electrodes 201(1, j) and 201(i+1, j), As a result, although the displayed image does not include the previously-described defects such as vertical-striped brightness unevenness in the configuration of FIG. 3, the displayed image includes some other defects such as regular brightness unevenness when no pattern is displayed (i.e., a solid image is displayed) on the screen of this LCD. This is due to the layout that the pixel electrodes written during the earlier subperiod TH1 are laid out between those written during the later subperiod TH2 along the scanning lines.

As understood from the above explanation, the above-described conventional improved configuration shown in FIGS. 3 and 5 has a problem that some brightness unevenness degrades the image quality.

Additionally, to solve this problem, another improved configuration of the active-matrix type color LCDs was developed, which is disclosed in the Japanese Non-Examined Patent Publication No. 63-202792 published in August 1988.

In this conflguration, an electrically conductive film is provided over a data line through a passivation film. The conductive film is applied with a fixed voltage. The parasitic capacitance between the data line and adjoining pixel electrodes is suppressed by shielding the electric field directed from the data line toward the pixel electrodes.

However, this configuration is unable to solve the above problem about brightness unevenness, because it does not suppress the parasitic capacitance $C_1$ and $C_2$ between the adjoining pixel electrodes but the parasitic capacitance between the data line and adjoining pixel electrodes.

SUMMARY OF THE INVENTION

Accordingly, an object of the present invention is to provide an LCD that solves the above-identified problem about brightness unevenness while suppressing the fabrication cost of a data driver circuit.

Another object of the present invention is to provide an LCD that improves the image quality.

The above objects together with others not specifically mentioned will become clear to those skilled in the art from the following description.

An LCD according to the present invention is comprised of (a) a first plurality of pixel electrodes arranged in a matrix array having rows and columns, (b) a second plurality of pixel electrodes arranged along the rows and columns of the matrix array, (c) a first plurality of scanning lines arranged along the respective rows of the matrix array, (d) a second plurality of scanning lines arranged along the respective rows of the matrix array, (e) data lines arranged along the respective columns of the matrix array, and (f) TFTs arranged at the respective intersections of the first and second pluralities of scanning lines with the data lines.

Each of the first plurality of pixel electrodes and a corresponding one of the second plurality of pixel electrodes are located at each side of a corresponding one of the data lines, forming an electrode pair.

Each of the first plurality of the scanning lines is used for supplying a first scanning signal to corresponding ones of the first plurality of pixel electrodes included in a corresponding one of the rows of the matrix array through corresponding ones of the TFTs during a first scanning subperiod of a predetermined scanning period.

Each of the second plurality of the scanning lines is used for supplying a second scanning signal to corresponding ones of the second plurality of pixel electrodes included in a corresponding one of the rows of the matrix array through corresponding ones of the TFTs during a second scanning subperiod of the scanning period subsequent to the first scanning subperiod.

Each of the data lines is commonly used for supplying a data signal to corresponding ones of the electrode pairs included in a corresponding one of the columns of the matrix array through corresponding ones of the TFTs.

The LCD according to the present invention is further comprised of a first plurality of fixed-potential electrodes and a second plurality of fixed-potential electrodes.

Each of the first plurality of fixed-potential electrodes is located between one of the first plurality of pixel electrodes and a corresponding one of the second pluralities of pixel electrodes that form one of the electrode pairs.

Each of the second plurality of fixed-potential electrodes is located between one of the first plurality of pixel electrodes and an adjoining one of the second plurality of pixel electrodes that are included in different ones of the electrode pairs.

The first and second pluralities of fixed-potential electrodes are designed to be applied with a fixed electric potential on operation.

With the LCD according to the present invention, the first plurality of fixed-potential electrodes and the second plurality of fixed-potential electrodes are respectively provided at the positions between adjoining two ones of the first and second pluralities of pixel electrodes.

Therefore, the capacitance of parasitic capacitors formed by adjoining ones of the first and second pluralities of pixel electrodes can be decreased or canceled. Thus, the above-identified problem about brightness unevenness can be solved. This means that the image quality is improved.

Also, because the basic configuration of the LCD is the same as that of the conventional one shown in FIGS. 2 and 3, the fabrication cost of a data driver circuit is suppressed.

In a preferred embodiment of the LCD according to the present invention, the first and second pluralities of fixed-potential electrodes serve to increase the storage capacitance of the pixel electrodes. In other words, they serve as storage electrodes. In the case, there is an additional advantage that the total storage capacitance of each of the first and second pluralities of the pixel electrodes is increased, In another preferred embodiment of the LCD according to the present invention, the first and second pluralities of fixed-potential electrodes are located in a same level as that of gate electrodes of the TFTs. In this case, there is an additional advantage that the first and second pluralities of fixed-potential electrodes can be formed by a same process as that of forming the gate electrodes.

In still another preferred embodiment of the LCD according to the present invention, the first and second pluralities of fixed-potential electrodes are located in a same level as that of gate electrodes of the TFTs. The first and second pluralities of pixel electrodes are formed over the TFTs through an Insulating film. Source or drain electrodes of the TFTs are electrically connected to the first and second pluralities of fixed-potential electrodes through contact holes of the insulating film. respectively. In this case, there is an additional advantage that the capacitance of the parasitic capacitors can be readily designed to be canceled completely.

In a further preferred embodiment of the LCD according to the present invention, the first and second pluralities of fixed-potential electrodes serve to light-shielding members. In this case, there is an additional advantage that the aperture ratio can be increased.

In a still further preferred embodiment of the LCD according to the present invention, a part of the first and second pluralities of fixed-potential electrodes are located in a same level as that of the data lines and the remaining first and second pluralities of fixed-potential electrodes are located in a same level as that of gate electrodes of the TFTs. The part of the first and second pluralities of fixed-potential electrodes are electrically connected to the remaining first and second pluralities of fixed-potential electrodes through contact holes of a gate insulating film, respectively. In this case, there is an additional advantage that the distances from the first and second pluralities of fixed-potential electrodes to the adjoining first and second pluralities of scanning lines and the adjoining data lines are decreased due to the eleotric-field shielding structure.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
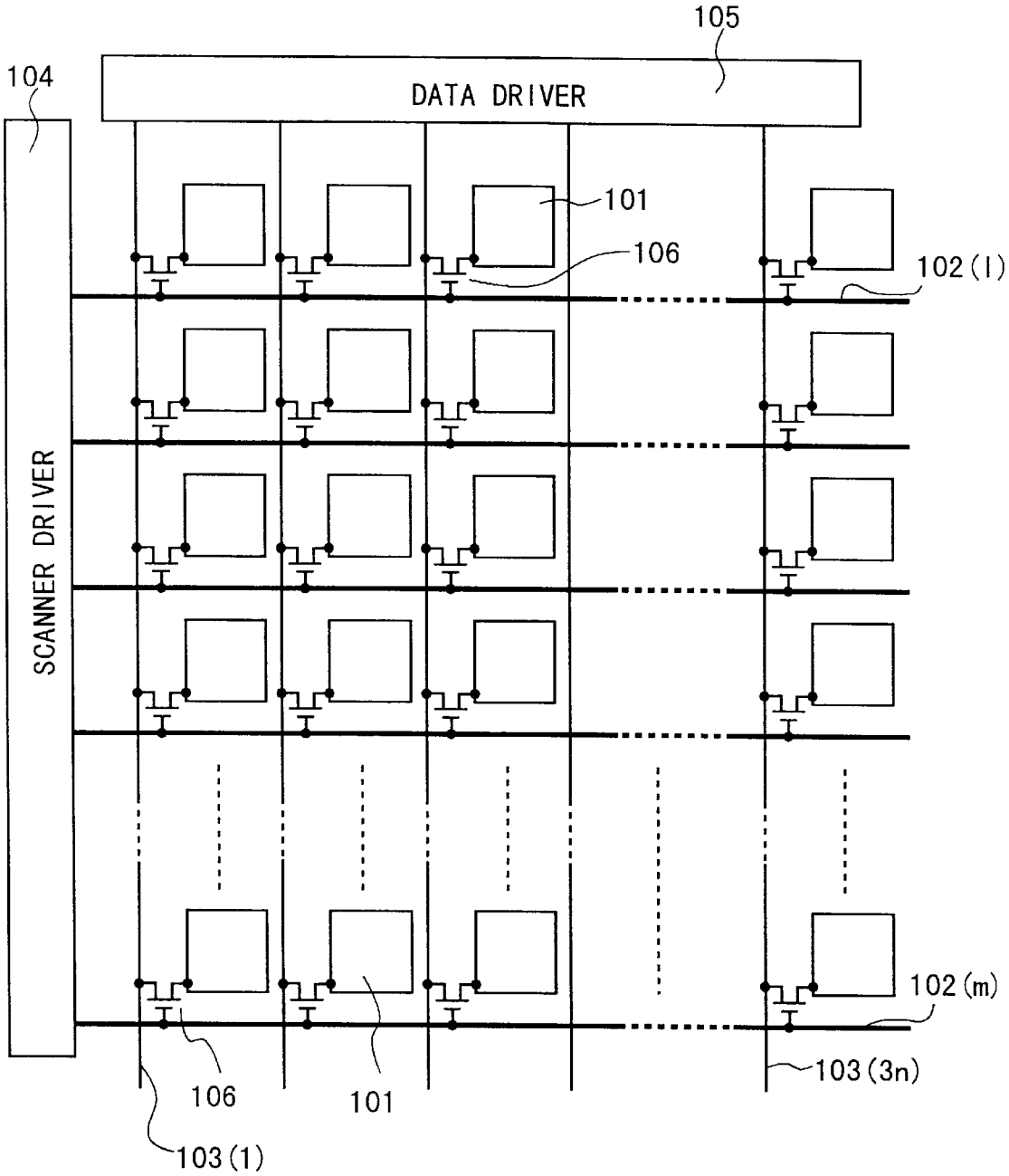
FIG. 1 PRIOR ART
FIG. 1 is a schematic plan view showing the configuration of a conventional LCD.

Preferred embodiments of the present invention will be described below referring to the drawings attached.

FIRST EMBODIMENT

Figure 10A:
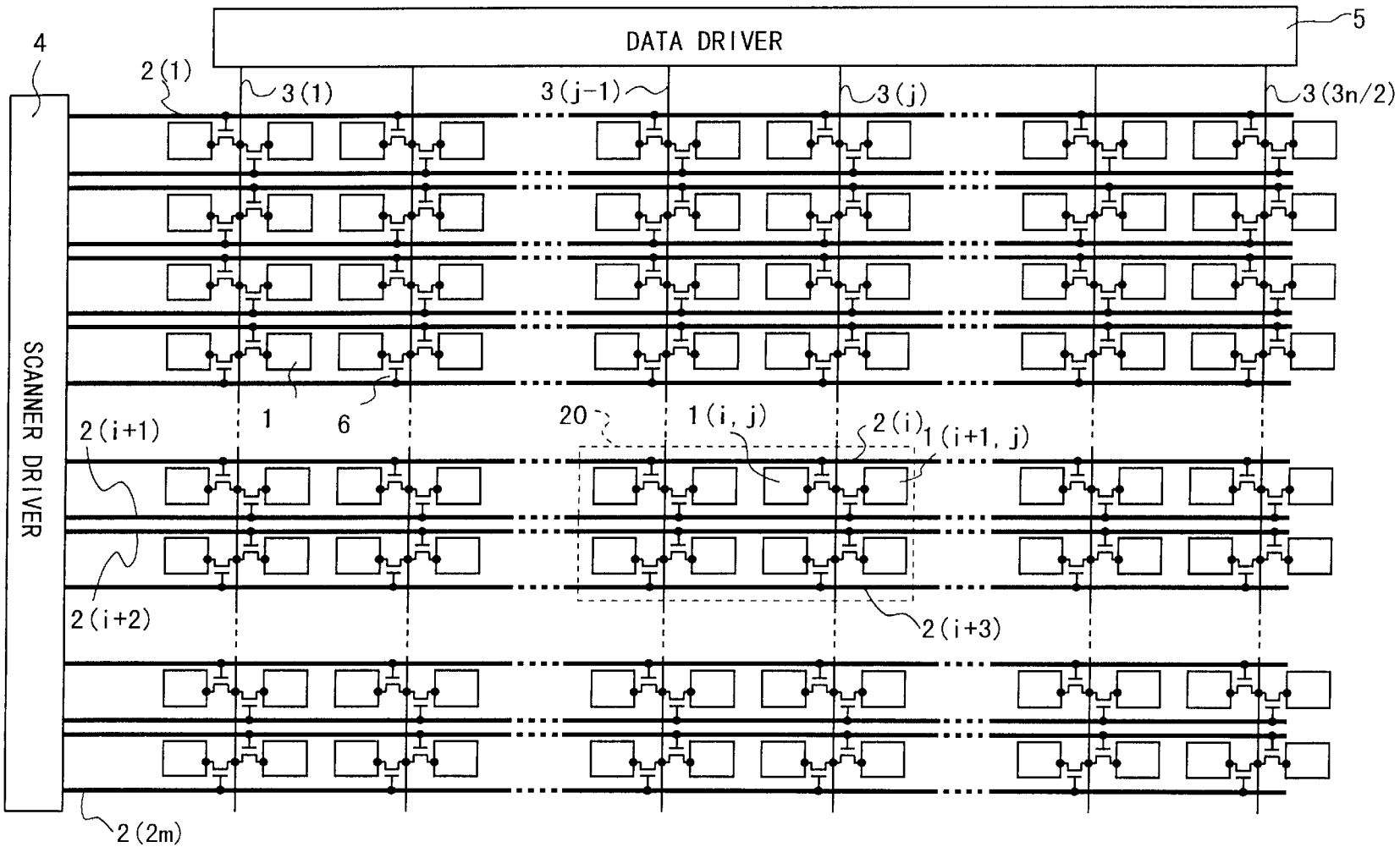
FIG. 10A is a schematic plan view showing the configuration of the LCD according to the first embodiment shown in FIG. 7.

A color LCD according to a first embodiment has a configuration as shown in FIG. 10A.

As shown in FIG. 10A, a plurality of pixel electrodes 1 are arranged in a matrix array with 2m rows and (3/2)n columns. The total number of these pixel electrodes 1 is 3(m×n).

A group of the [(2/3)m×(1/2)n] pixel electrodes 1 are used for displaying the red (R) color, forming R subpixels. Another group of the [(2/3)m×(l/2)n] pixel electrodes 1 are used for displaying the green (G) color, forming G subpixels. The remaining [(2/3)m×(1/2)n] pixel electrodes 1 are used for displaying the blue (B) color, forming B subpixels. Thus, the total number of pixels or dots of this color LCD is (m×n) (=3[(2/3)m×(1/2)n]).

First to 2m-th scanning lines 2(1) to 2(2m) are arranged along the respective rows of the matrix array. First to (3/2)n-th data lines 3(1) to 3(3n/2) are arranged along the respective columns of the matrix array. 3(m×n) TFTs 6 are arranged at the respective intersections of the scanning lines 2(1) to 2(2m) and the data lines 3(1) to 3(3n/2).

The scanning lines 2(1) to 2(2m) are driven by a scanner driver circuit 4. The data lines 3(1) to 3(3n/2) are driven by a data driver circuit 5.

Figure 10B:
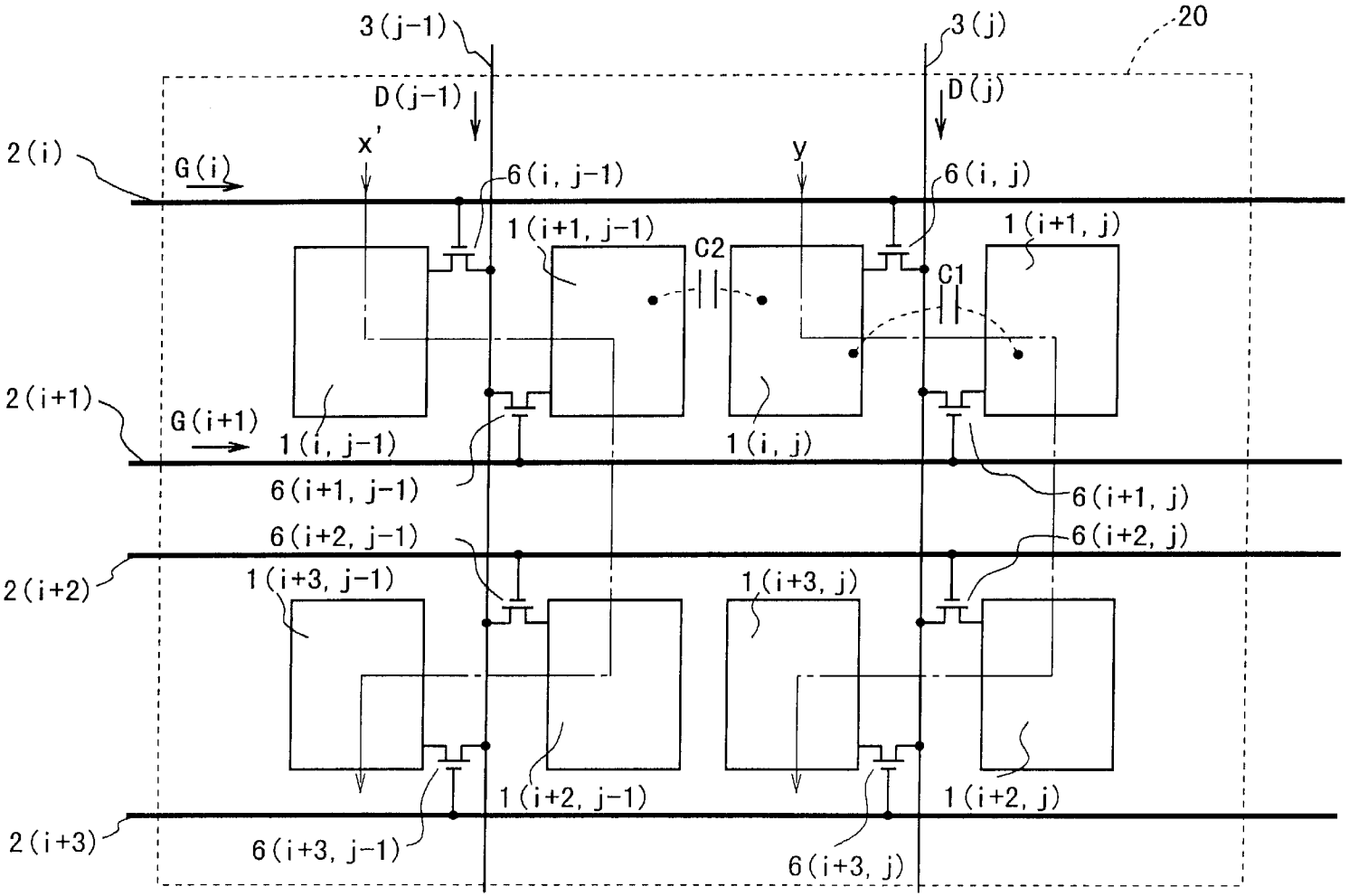
FIG. 10B is a partial, enlarged, schematic view of a part of the configuration of the LCD according to the first embodiment shown in FIG. 7.

The electrical connection of the TFTs 6 to the scanning lines 2(1) to 2(2m), the data lines 3(1) to 3(3n/2), and the pixel electrodes 1 is shown in detail in FIG. 10B.

In FIG. 10B, a part 20 of the matrix array is illustrated, which includes the intersections of the (j−1)-th and j-th data lines 3(j−1) and 3(j) with the i-th, (i+1)-th, (i+2)-th, and (i+3)-th scanning lines 2(i), 2(i+1), 2(i+2), and 2(i+3), and their neighborhood. Here, i and j are natural numbers satisfying the relationships of $1 \leqq i \leqq 2m$ and $1 \leqq j \leqq 3n/2$.

The TFT 6(i, j), which is located at the intersection of the i-th scanning line 2(i) and the j-th data line 3(j), has a gate electrically connected to the i-th scanning line 2(i), a drain electrically connected to the j-th data line 3(j), and a source electrically connected to the corresponding pixel electrode 1(i, j). Similarly, the TFT 6(i+1, j), which is located at the intersection of the (i+1)-th scanning line 2(i+1) and the j-th data line 3(j), has a gate electrically connected to the (i+1)-th scanning line 2(i+1), a drain electrically connected to the j-th data line 3(j), and a source electrically connected to the corresponding pixel electrode 1(i+1, j). Thus, the j-th data line 3(j) is commonly used by the two TFTs 6(i, j) and 6(i+1, j). The i-th and (i+1)-th scanning lines 2(i) and 2(i+1) are respectively used by these two TFTs 6(i, j) and 6(i+1, j).

The TFT 6(i, j−1), which is located at the intersection of the i-th scanning line 2(i) and the (j−1)-th data line 3(j−1), has a gate electrically connected to the i-th scanning line 2(i), a drain electrically connected to the (j−1)-th data line 3(j−1), and a source electrically connected to the corresponding pixel electrode 1(i, j−1). Similarly, the TFT 6(i+1, j−1). which is located at the intersection of the (i+1)-th scanning line 2(i+1) and the (j−1)-th data line 3(j−1), has a gate electrically connected to the (i+1)-th scanning line 2(i+1), a drain electrically connected to the (j−1)-th data line 3(j−1), and a source electrically connected to the corresponding pixel electrode 1(i+1, j−1). Thus, the (j−1)-th data line 3(j−1) is commonly used by the two TFTs 6(i, j−1) and 6(i+1, j−1). The i-th and (i+1)-th scanning lines 2(i) and 2 (i+1) are respectively used by these two TFTS 6(i, j−1) and 6(i+1, j−1).

The TFT 6(i+2, j−1), which is located at the intersection of the (i+2)-th scanning line 2(i+2) and the (j−1)-th data line 3(j−1), has a gate electrically connected to the (i+2)-th scanning line 2(i+2), a drain electrically connected to the (j−1)-th data line 3(j−1), and a source electrically connected to the corresponding pixel electrode 1(i+2, j−1). Similarly, the TFT 6(i+3, j−1), which is located at the intersection of the (i+3)-th scanning line 2(i+3) and the (j−1)-th data line 3(j−1), has a gate electrically connected to the (i+3)-th scanning line 2(i+3), a drain electrically connected to the (j−1)-th data line 3(j−1), and a source electrically connected to the corresponding pixel electrode 1(i+3, j−1). Thus, the (j−1)-th data line 3(j−1) is commonly used by the two TFTs 6(i+2, j−1) and 6(i+3, j−1). The (i+2)-th and (i+3)-th scanning lines 2(i+2) and 2(i+3) are respectively used by these two TFTs 6(i+2, j−1) and 6(i+3, j−1).

The TFT 6(i+2, j), which is located at the intersection of the (i+2)-th scanning line 2(i+2) and the j-th data line 3(j), has a gate electrically connected to the (i+2)-th scanning line 2(i+2), a drain electrically connected to the j-th data line 3(j), and a source electrically connected to the corresponding pixel electrode 1(i+2, j). Silmilarly, the TFT 6(i+3, j), which is located at the intersection of the (i+3)-th scanning line 2(i+3) and the j-th data line 3(j), has a gate electrically connected to the (i+3)-th scanning line 2(i+3), a drain electrically connected to the j-th data line 3(j), and a source electrically connected to the corresponding pixel electrode 1(i+3, j). Thus, the j-th data line 3(j) is commonly used by the two TFTs 6(i+2, j) and 6(i+3, j). The (i+2)-th and (i+3)-th scanning lines 2(i+2) and 2(i+3) are respectively used by these two TFTs 6(i+2, j) and 6(i+3, j).

As described above, with the configuration shown in FIG. 10A, two ones of the scanning lines 2(1) to 2(2m) are provided for each row of the matrix array of the pixels and each of the data lines 3(1) to 3(3n/2) is commonly used by two adjoining columns thereof. Accordingly, the number of the necessary scanning lines is 2m and the number of the necessary data lines is (3n/2) for (m×n) color pixels.

For example, if the LCD has a resolution of (640×480) pixels according to the VGA standard, the number of the necessary scanning lines is 960 (=480×2), the number of the necessary data lines is 960 (=640×3/2), and the number of the pixel electrodes is 960 (=640×3/2).

Therefore, the number of the necessary data lines is decreased to a half of that of the conventional configuration shown in FIG. 1. As a result, the fabrication cost of the data driver circuit is able to be reduced.

Figure 2:
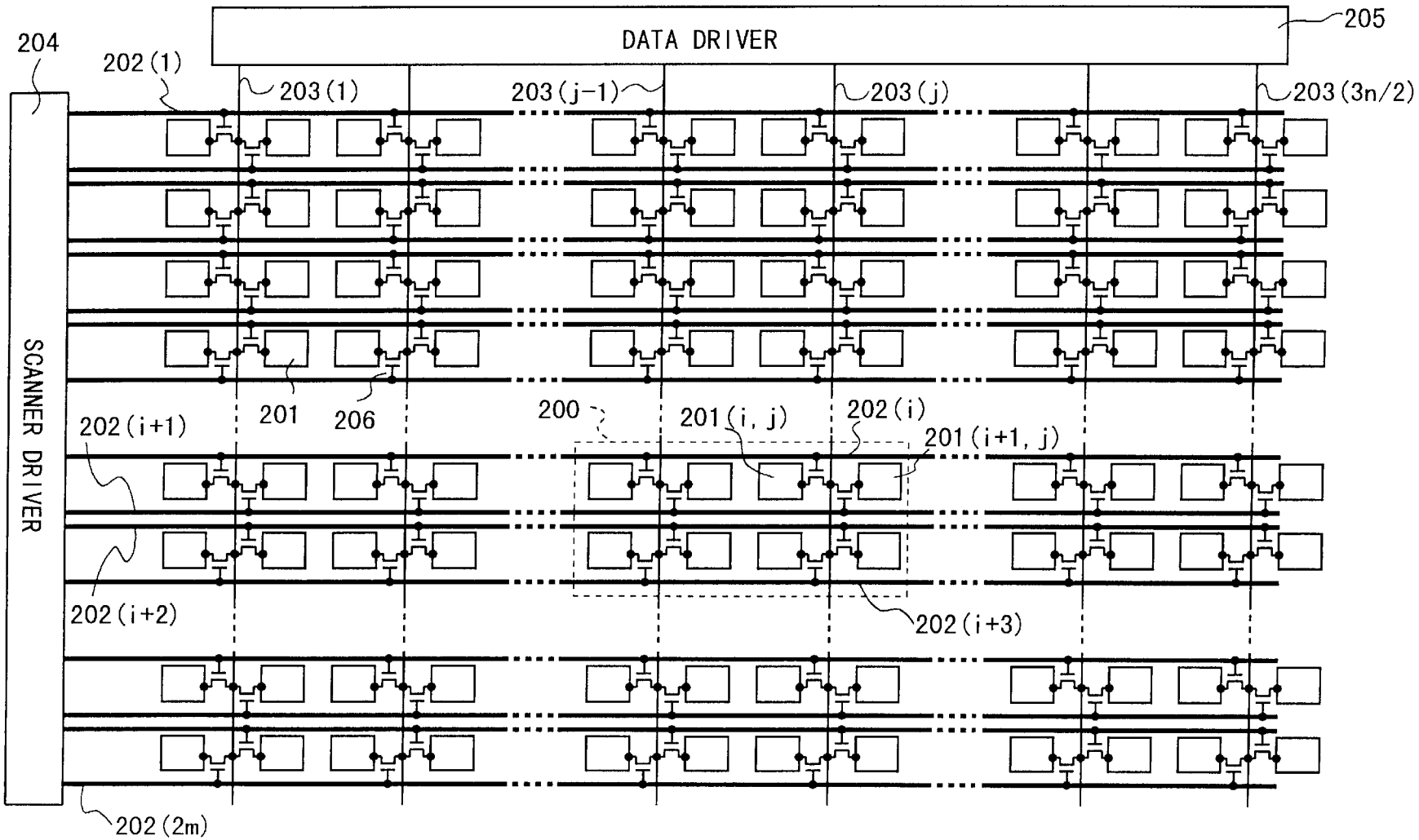
FIG. 2 PRIOR ART
FIG. 2 is a schematic plan view showing the configuration of another conventional LCD.
Figure 3:
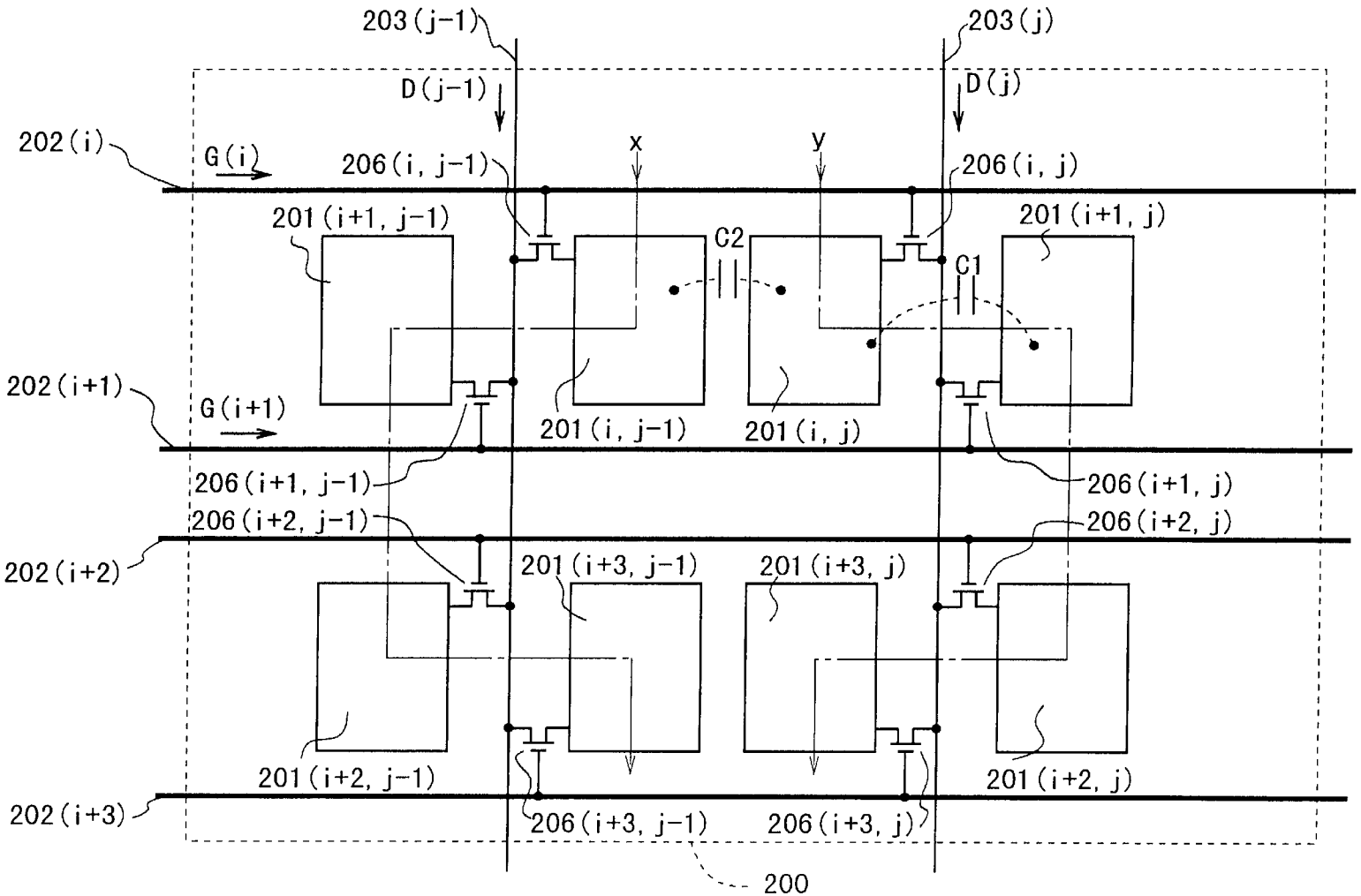
FIG. 3 PRIOR ART
FIG. 3 is a partial, enlarged view of a part of the configuration of the conventional LCD shown in FIG. 2.
Figure 4A:
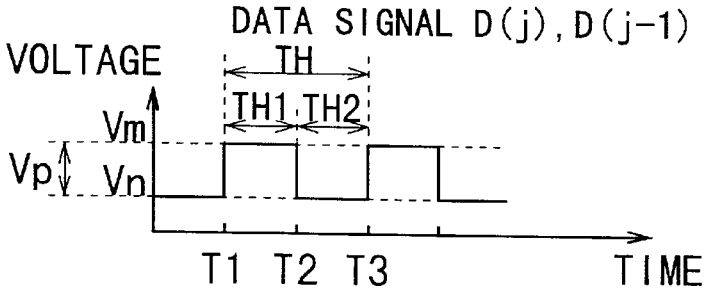
FIG. 4A PRIOR ART
FIG. 4A is a timing chart showing the voltage change of the data signals D(j) and D(j−1) of the conventional LCD shown in FIGS. 2 and 3.
Figure 4B:
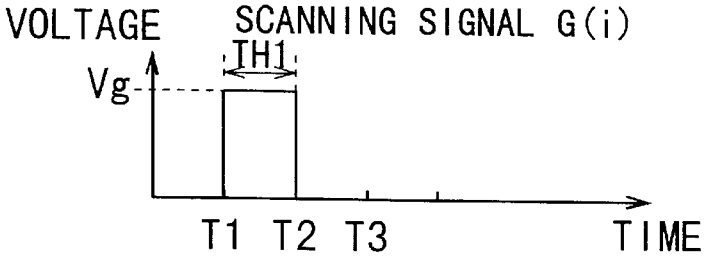
FIG. 4B PRIOR ART
FIG. 4B is a timing chart showing the voltage change of the scanning signals G(i) of the conventional LCD shown in FIGS. 2 and 3.
Figure 4C:
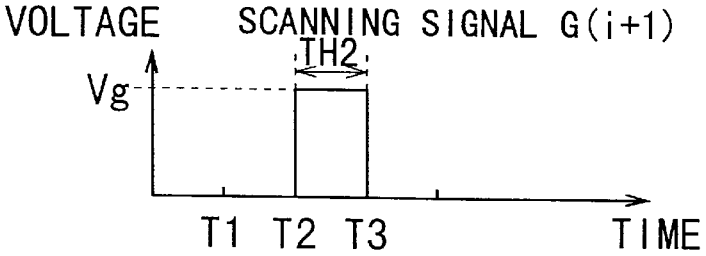
FIG. 4C PRIOR ART
FIG. 4C is a timing chart showing the voltage change of the scanning signals G(i+1) of the conventional LCD shown in FIGS. 2 and 3.
Figure 4D:
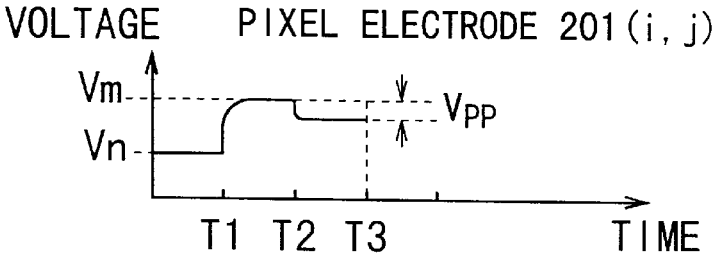
FIG. 4D PRIOR ART
FIG. 4D is a timing chart showing the voltage change of the pixel electrode 201(i, j) of the conventional LCD shown in FIGS. 2 and 3.
Figure 4E:
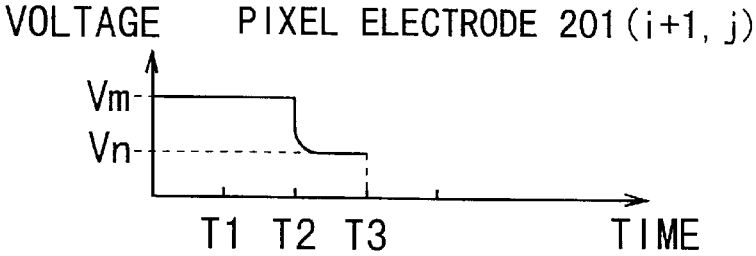
FIG. 4E PRIOR ART
FIG. 4E is a timing chart showing the voltage change of the pixel electrode 201(i+1, j) of the conventional LCD shown in FIGS. 2 and 3.
Figure 5:
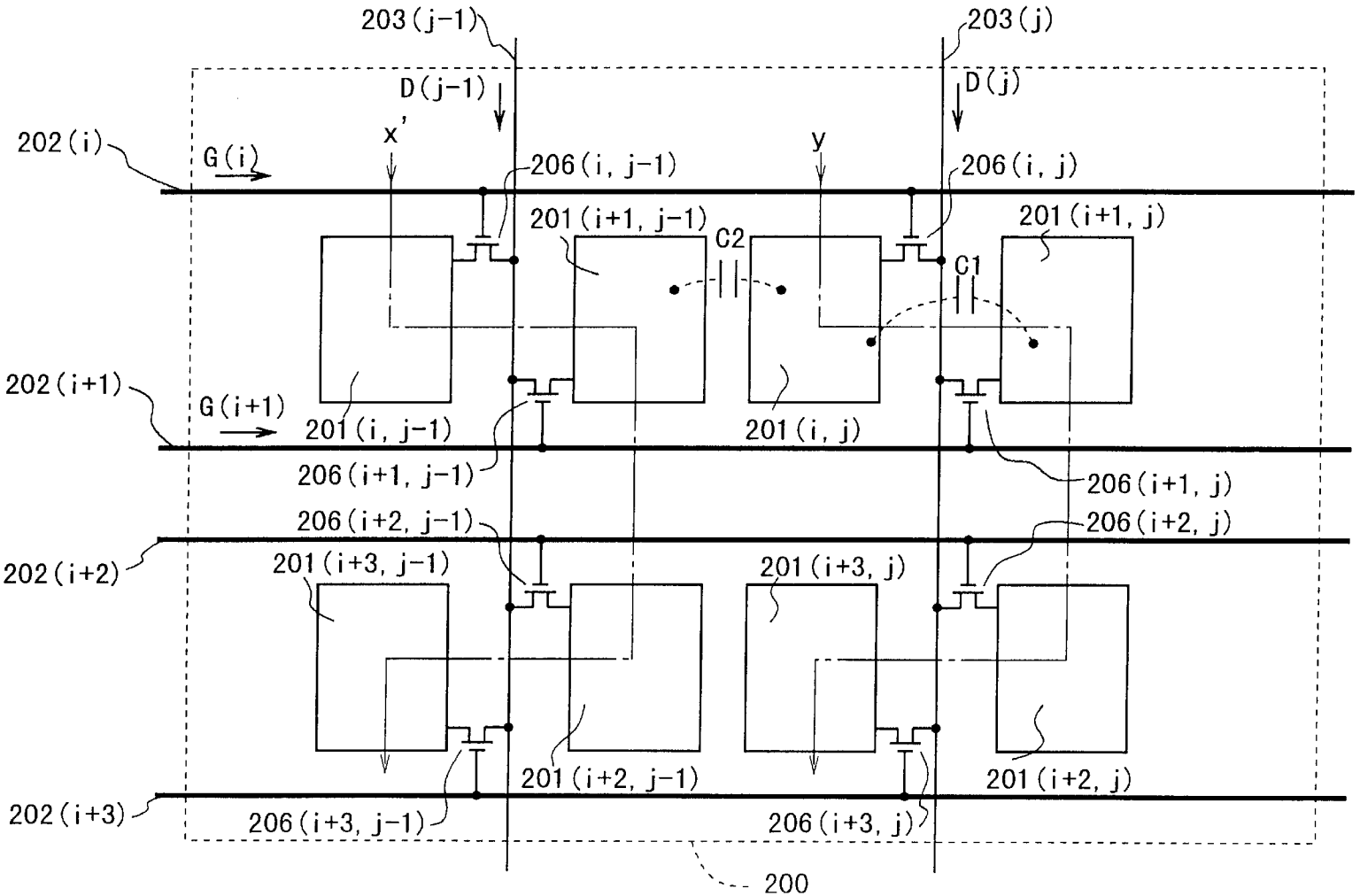
FIG. 5 PRIOR ART
FIG. 5 is a partial, enlarged view of a part of another configuration of the conventional LCD shown in FIG. 2.
Figure 6A:
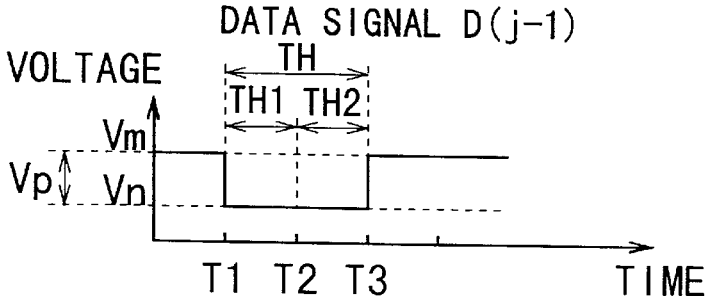
FIG. 6A PRIOR ART
FIG. 6A is a timing chart showing the voltage change of the data signal D(j−1) of the conventional LCD shown in FIG. 5.
Figure 6B:
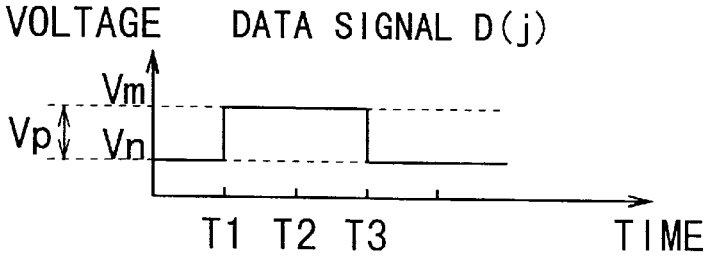
FIG. 6B PRIOR ART
FIG. 6B is a timing chart showing the voltage change of the data signal D(j) of the conventional LCD shown in FIG. 5.
Figure 6C:
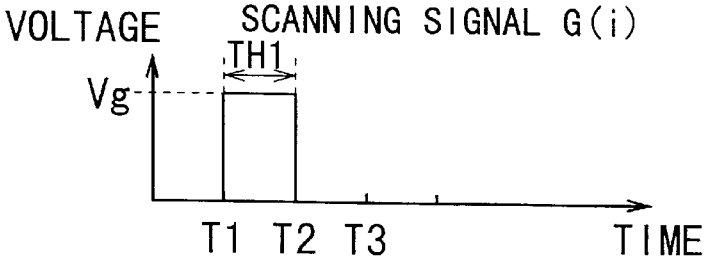
FIG. 6C PRIOR ART
FIG. 6C is a timing chart showing the voltage change of the scanning signal G(i) of the conventional LCD shown in FIG. 5.
Figure 6D:
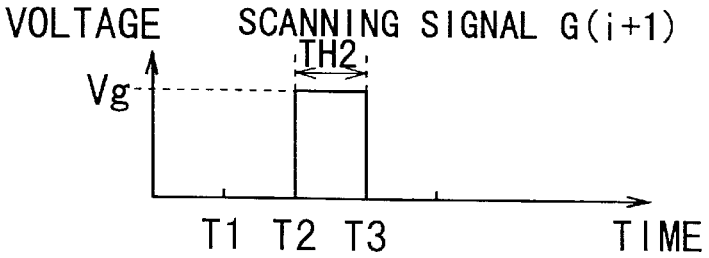
FIG. 6D PRIOR ART
FIG. 6D is a timing chart showing the voltage change of the scanning signal G(i+1) of the conventional LCD shown in FIG. 5.
Figure 6E:
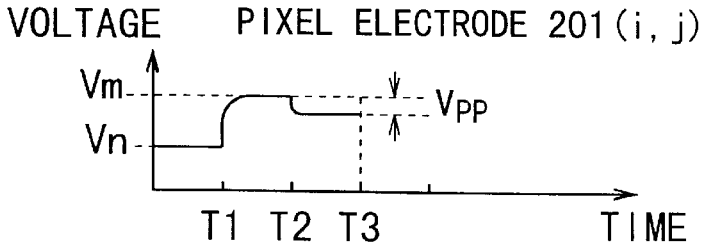
FIG. 6E PRIOR ART
FIG. 6E is a timing chart showing the voltage change of the pixel electrode 201(i, j) of the conventional LCD shown in FIG. 5.
Figure 6F:
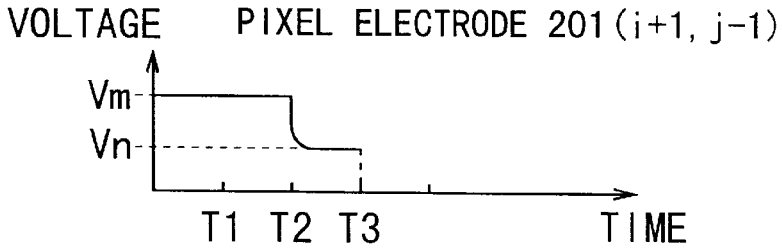
FIG. 6F PRIOR ART
FIG. 6F is a timing chart showing the voltage change of the pixel electrode 201(i+1, j−1) of the conventional LCD shown in FIG. 5.
Figure 6G:
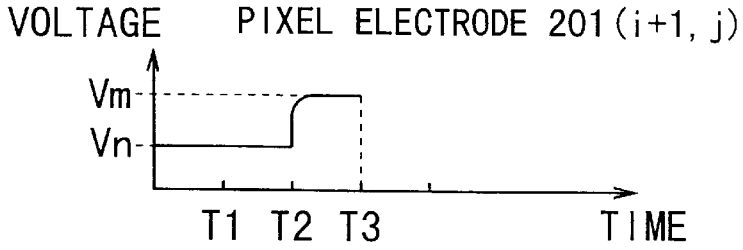
FIG. 6G PRIOR ART
FIG. 6G is a timing chart showing the voltage change of the pixel electrode 201(i+1, j) of the conventional LCD shown in FIG. 5.

The above-described configuration is the same as that of the conventional LCD shown in FIGS. 2 and 3.

Figure 7:
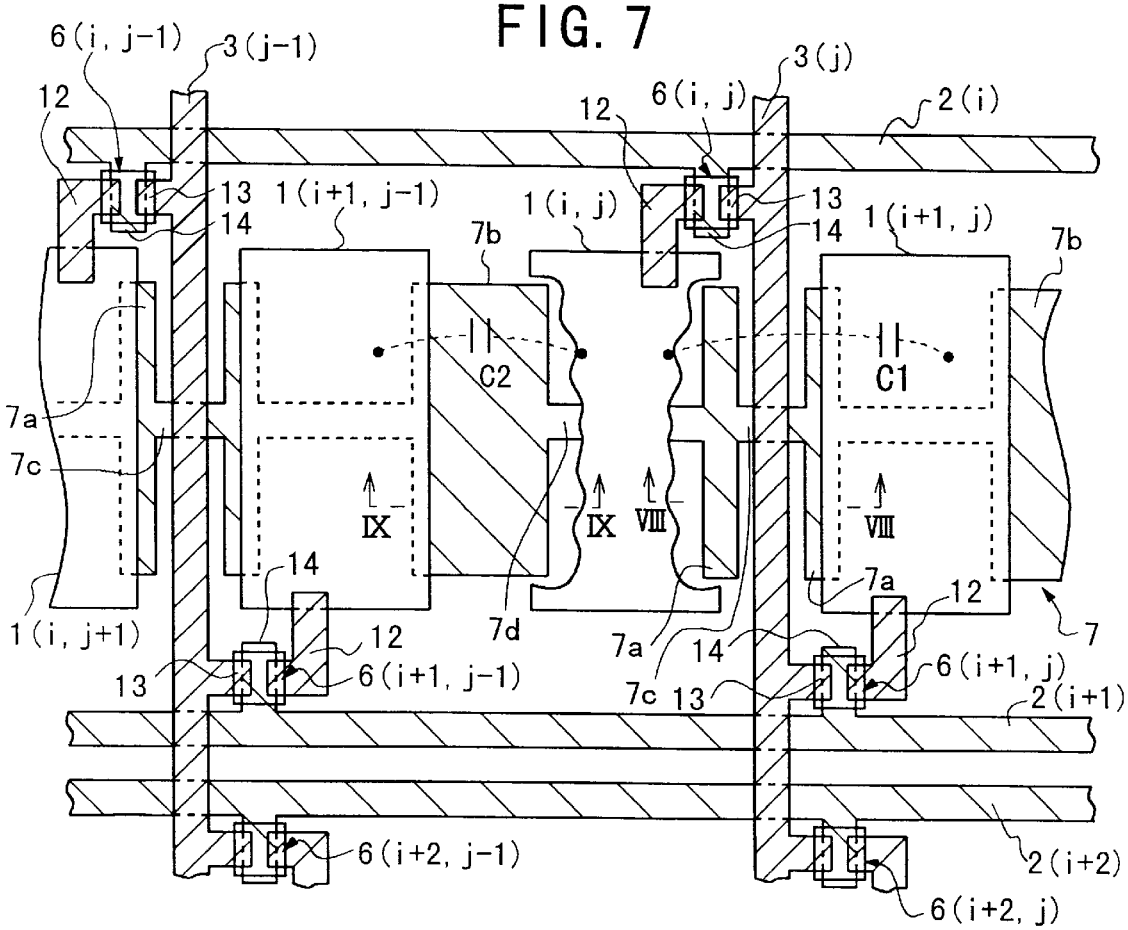
FIG. 7 is a partial, enlarged plan view of a part of the configuration of a color LCD according to a first embodiment of the present invention.
Figure 8:
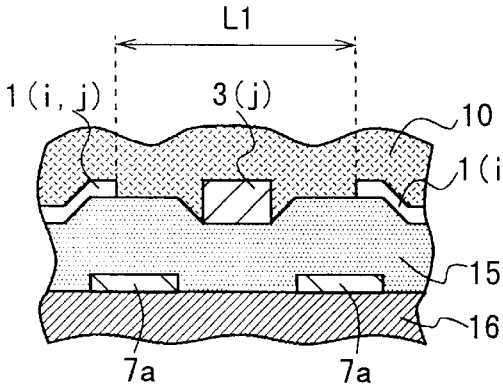
FIG. 8 is a partial, cross-sectional view of the LCD according to the first embodiment, which is along the line VIII—VIII in FIG. 7.
Figure 9:
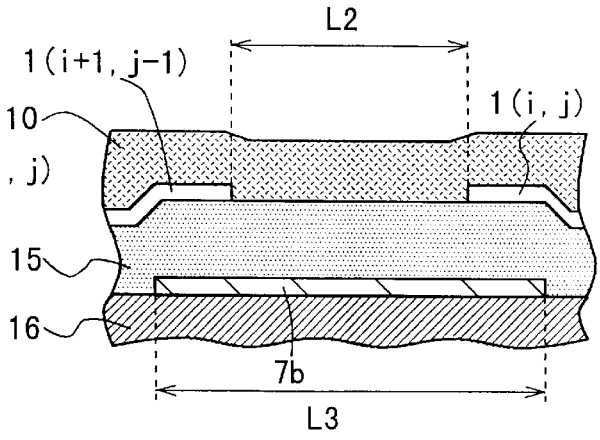
FIG. 9 is a partial, cross-sectional view of the LCD according to the first embodiment, which is along the line IX—IX in FIG. 7.

Unlike the conventional LCD shown in FIGS. 2 and 3, the LCD according to the first embodiment has an electrically conductive film 7 formed on a glass substrate 16, as shown in FIGS. 7, 8, and 9.

This conductive film 7 has a pattern as clearly shown in FIG. 7. This conductive film 7 defines fixed-potential electrodes 7*a* and 7*b* to which a fixed electric potential is applied on operation. Each of the fixed-potential electrodes 7*a* and 7*b* has a rectangular plan shape whose longitudinal axis extends along the data lines 3(1) to 3(3n/2). Two adjoining ones of the electrodes 7*a* are connected to each other by a strip-shaped connection part 7*c*. Two adjoining ones of the electrodes 7*b* are connected to each other by a strip-shaped connection part 7*d*. The longitudinal axes of the connection parts 7*c* and 7*d* extend along the scanning lines 2(1) to 2(2m).

The fixed-potential electrodes 7*a* and 7*b* have a function of increasing the storage capacitance of the corresponding pixel electrodes 1.

Figure 20:
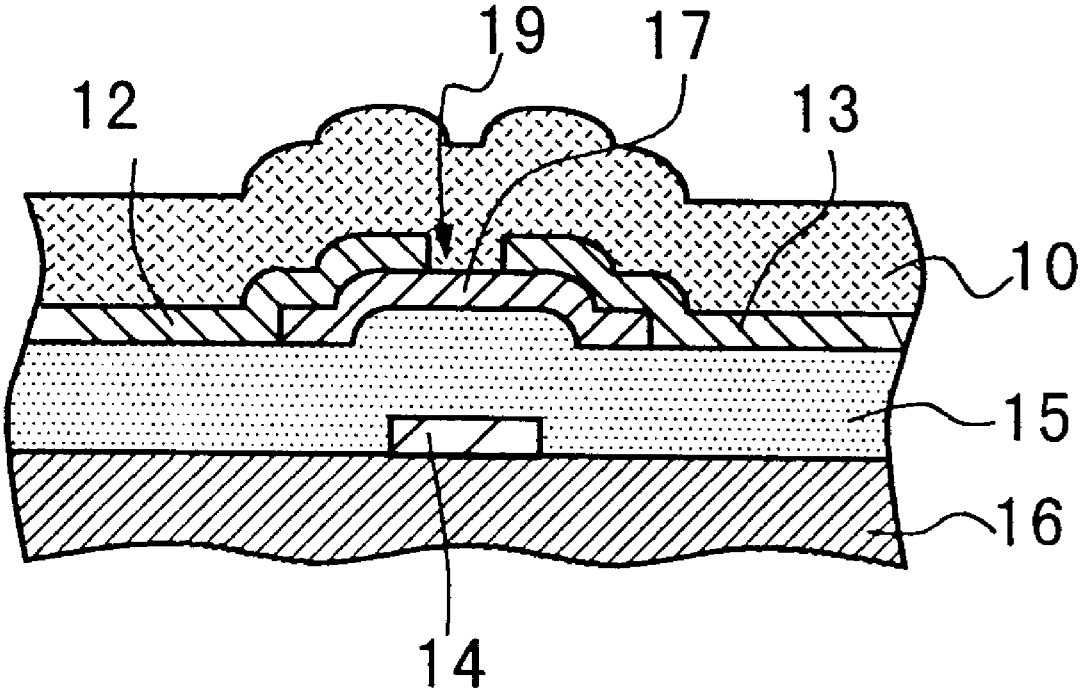
FIG. 20 is a partial, cross-sectional view of the TFT used in the LCDs according to the first to third embodiments.

Each of the TFTs 6 has a configuration as shown in FIG. 20, which is of the inverted staggered type. A gate electrode 14 is formed on the same glass substrate 16. A gate insulating film 15 is formed on the substrate 16 to cover the gate electrode 14. An amorphous silicon film 17 is formed on the gate insulating film 15 to be overlapped with the gate electrode 14. A source electrode 12 and a drain electrode 13 are formed on the gate insulating film is to be partially overlapped with the amorphous silicon film 17. The source electrode 12 is apart from the drain electrode 13, forming a channel region 18 at an exposed part of the amorphous silicon film 17, A protection film 18 is formed to cover the whole TFT 1.

The electrically conductive film 7 for the fixed-potential electrodes 7*a* and 7*b* is the same as an electrically conductive film used for forming the scanning lines 2 and the gate electrodes 14 of the TFTs 6. Therefore, the fixed-potential electrodes 7*a* and 7*b* and the connection parts 7*c* and 7*d* may be formed in the same process step as that of the scanning lines 2(1) to 2(2m) and the gate electrodes 14.

The data lines 3(1) to 3(3m/2) are formed on the gate insulating film 15, as shown in FIG. 8.

As shown in FIG. 8, the end of the fixed-potential electrode 7*a* is overlapped with the overlying pixel electrode 1(i, j) or 1(i+1, j), and is not overlapped with the overlying data line 3(j). The data line 3(j) is located at the middle of these two electrodes 7*a*.

As shown in FIG. 9, both ends of the fixed-potential electrode 7*b* are overlapped with the overlying pixel electrodes 1(i, j) and 1(i+1, j−1), respectively. The electrode 7*b* is located at the middle of these electrodes 1(i, j) and 1(i+1, j−1).

The distance L1 between the opposing ends of the adjoining pixel electrodes 1(i, j) and 1(i+1, j) and the distance L2 between the opposing ends of the adjoining pixel electrodes 1(i, j) and 1(i+1, j−1) are determined so that the capacitances of the parasitic capacitances C1 and C2 are equal to each other, where the parasitic capacitances C1 is generated by the adjoining pixel electrodes 1(i, j) and 1(i+1, j) and the parasitic capacitances C2 is generated by the adjoining pixel electrodes 1(i, j) and 1(i+1, j−1).

To adjust the capacitances of the parasitic capacitances C1 and C2, the width L3 of the fixed-potential electrode 7*b* may be changed.

Next, a driving method of the color LCD according to the first embodiment will be explained below with reference to FIGS. 11A to 11G.

In this driving method, the scanning lines 2(1) to 2(2m) are successively activated from the first scanning line 2(1) to the last or 2m-th scanning line 2(2m). The data lines 3(1) to 3(3n/2) are successively activated from the first data line 3(1) to the last or (3n/2)-th data line 3(3n/2) synchronized with the activation behavior of the scanning lines 2(1) to 2(2m), thereby displaying a required color image on the screen of this LCD.

A scanning period TH for each row of the matrix array is divided into two subperiods. i.e., earlier and later subperiods TH1 and TH2, In FIG. 10B, the pixel electrodes 1(i, j) and 1(i, j−1) electrically connected to the scanning line 2(i) are driven or written during the earlier subperiod TH1. The pixel electrodes 1(i+1, j) and 1(i+1, j−1) electrically connected to the scanning line 2(i+1) are driven during the later subperiod TH2. Similarly, the pixel electrodes 1(i+2, j) and 1(i+2, j−1) electrically connected to the scanning line 2(i+2) are driven during the earlier subperiod TH1. The pixel electrodes 1(i+3, j) and 1(i+3, j−1) electrically connected to the scanning line 2(i+3) are driven during the later subperiod TH2.

Thus, the pixel electrodes 1(i, j), 1(i+1, j), 1(i+2, j), and 1(i+3, j). which are electrically connected in common to the data line 3(j), are successively activated in this order. This means that the activation or driving order is along an arrow y shown in FIG. 10B. The pixel electrodes 1(i, j−1), 1(i+1, j−1), 1(i+2, j−1), and 1(i+3, j−1), which are electrically connected in common to the data line 3(j−1), are successively activated in this order along an arrow x' shown in FIG. 10B.

Figure 11A:
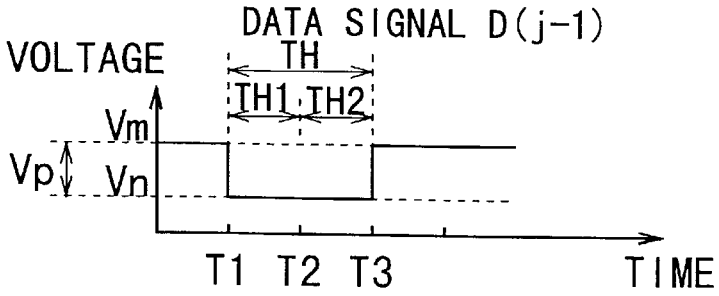
FIG. 11A is a timing chart showing the voltage change of the data signal D(j−1) of the LCD according to the first embodiment shown in FIG. 7.
Figure 11B:
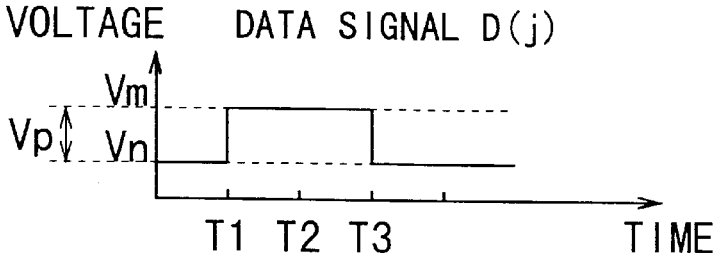
FIG. 11B is a timing chart showing the voltage change of the data signal D(j) of the LCD according to the first embodiment shown in FIG. 7.
Figure 11C:
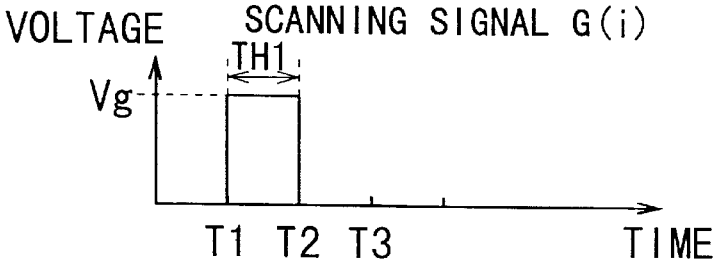
FIG. 11C is a timing chart showing the voltage change of the scanning signal G(i) of the LCD according to the first embodiment shown in FIG. 7.

Specifically, as shown in FIG. 11C, when the i-th scanning line 2(i) is applied with a scanning signal G(i) of a voltage level $V_g$ (in other words, the i-th scanning line 2(i) is activated) during an earlier subperiod TH1 (which starts at the time T1 and ends at the time T2), a data signal D(j) of a high-level voltage $V_m$ is applied to or written in the pixel electrode 1(i, j) through the data line 3(j). Thus, the voltage of the pixel electrode 1(i, j) is turned from a low-level voltage $V_n$ to the high-level voltage $V_m$ at the time T1, and it is kept unchanged during the earlier subperiod TH1, as shown in FIG. 11E.

Figure 11D:
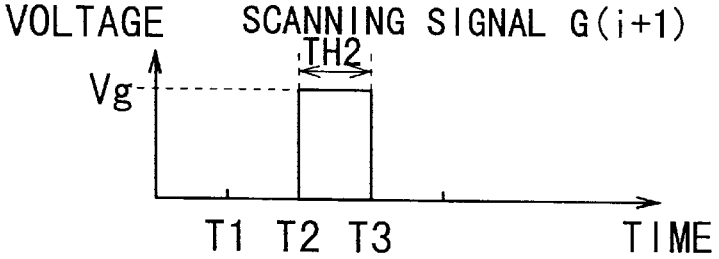
FIG. 11D is a timing chart showing the voltage change of the scanning signal G(i+1) of the LCD according to the first embodiment shown in FIG. 7.
Figure 11E:
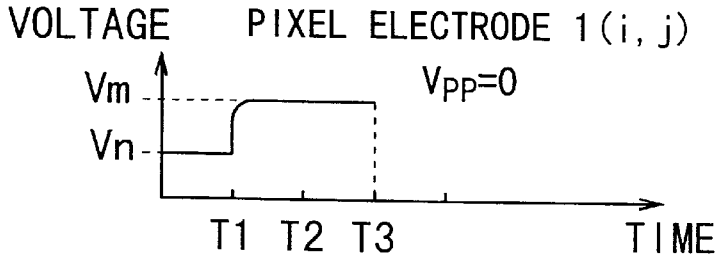
FIG. 11E is a timing chart showing the voltage change of the pixel electrode 1(i, j) of the LCD according to the first embodiment shown in FIG. 7.
Figure 11F:
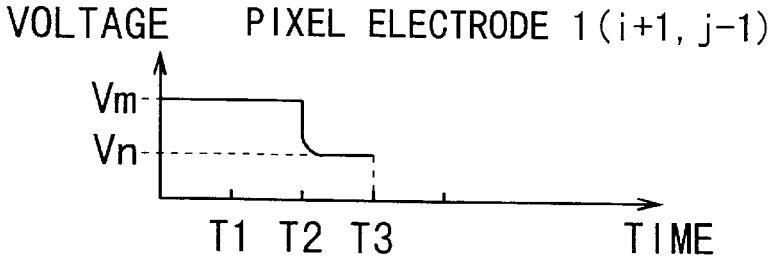
FIG. 11F is a timing chart showing the voltage change of the pixel electrode 1(i+1, j−1) of the LCD according to the first embodiment shown in FIG. 7.
Figure 11G:
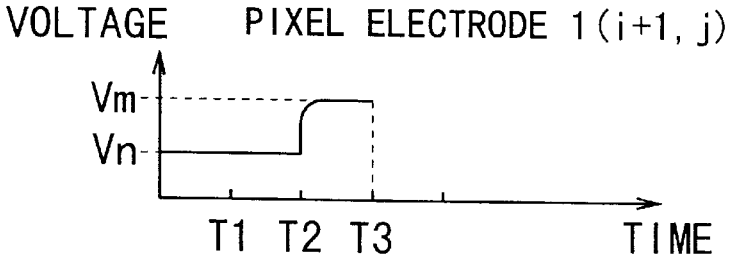
FIG. 11G is a timing chart showing the voltage change of the pixel electrode 1(i+1, j) of the LCD according to the first embodiment shown in FIG. 7.
Figure 12A:
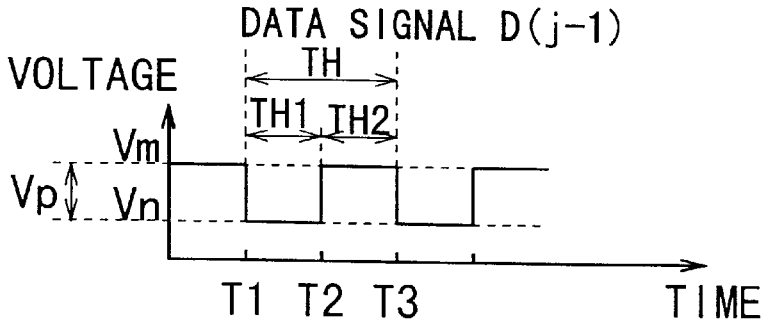
FIG. 12A is a timing chart showing the voltage change of the data signal D(j−1) of the LCD according to the first embodiment shown in FIG. 7.
Figure 12B:
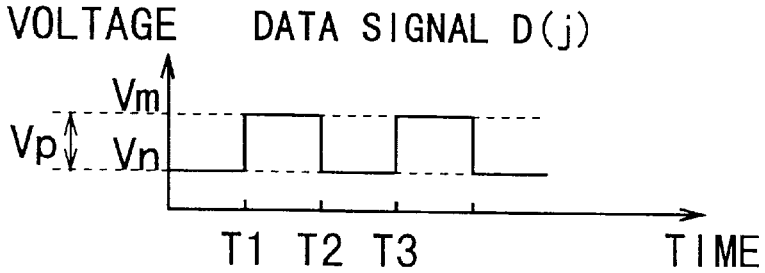
FIG. 12B is a timing chart showing the voltage change of the data signal D(j) of the LCD according to the first embodiment shown in FIG. 7.
Figure 12C:
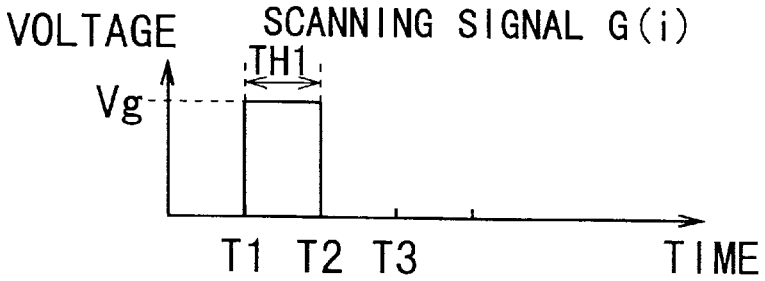
FIG. 12C is a timing chart showing the voltage change of the scanning signal G(i) of the LCD according to the first embodiment shown in FIG. 7.
Figure 12D:
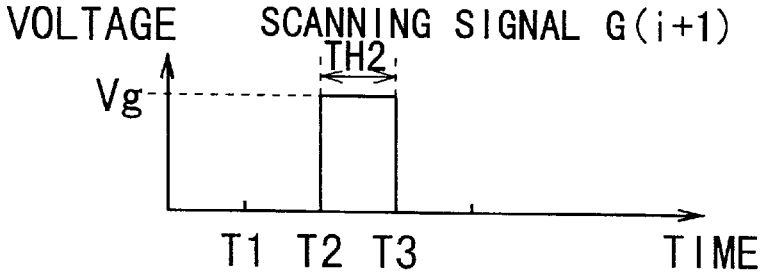
FIG. 12D is a timing chart showing the voltage change of the scanning signal G(i+1) of the LCD according to the first embodiment shown in FIG. 7.
Figure 12E:
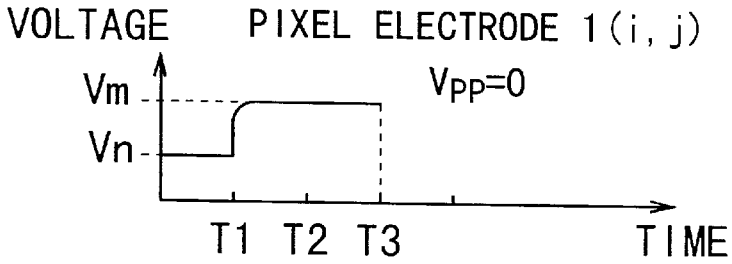
FIG. 12E is a timing chart showing the voltage change of the pixel electrode 1(i, j) of the LCD according to the first embodiment shown in FIG. 7.
Figure 12F:
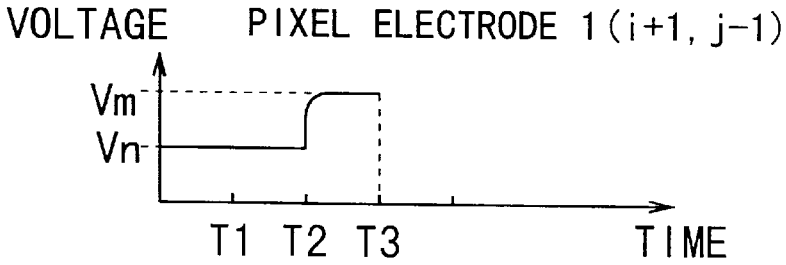
FIG. 12F is a timing chart showing the voltage change of the pixel electrode 1(i+1, j−1) of the LCD according to the first embodiment shown in FIG. 7.
Figure 12G:
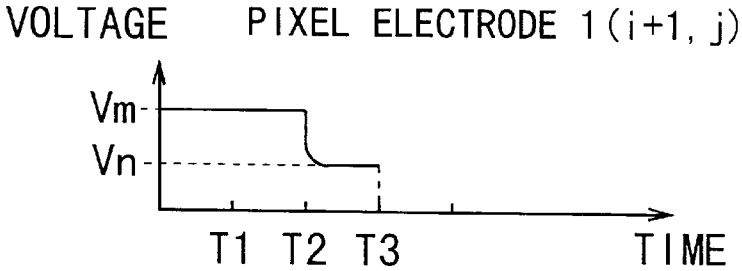
FIG. 12G is a timing chart showing the voltage change of the pixel electrode 1(i+1, j) of the LCD according to the first embodiment shown in FIG. 7.

Next, when the (i+1)-th scanning line 2(i+1) is applied with a scanning signal G(i+1) of the same voltage level $V_g$ (in other words, the (i+1)-th scanning line 2(i+1) is activated) during a later subperiod TH2 (which starts at the time T2 and ends at the time T3), as shown in FIG. 11D, the data signal D(j) of the high-level voltage $V_m$ is applied to or written in the pixel electrode 1(i+1, j) through the same data line 3(j). Thus, the voltage of the pixel electrode 1(i+1, j) is turned from the low-level voltage $V_n$ to the high-level voltage $V_m$ at the time T2, and it is kept unchanged during the later subperiod TH2, as shown in FIG. 11G.

Simultaneously with the application of a scanning signal G(i+1) of the same voltage level $V_g$ to the (i+1)-th scanning line 202(i+1) during the later subperiod TH2, as shown in FIG. 11D, the data signal D(j−1) of the low-level voltage $V_n$ is applied to or written in the pixel electrode 1(i+1, j−1) through the data line 3(j−1). Thus, the voltage of the pixel electrode 1(i+1, j−1) is turned from the high-level voltage $V_m$ to the low-level voltage $V_n$ at the time T2, and it is kept unchanged during the later subperiod TH2, as shown in FIG. 11F.

With the LCD according to the first embodiment, pairs of the fixed-potential electrodes 7*a* are respectively provided at the positions between adjoining two ones of the pixel electrodes 1 in which the data lines 3 exist, and the fixed-potential electrodes 7*b* are respectively provided at the positions between adjoining two ones of the pixel electrodes 1 in which no data lines exists.

Therefore, the effects given by the parasitic capacitors C1 and C2 to the voltages of the adjoining two pixel electrodes 1 can be canceled, thereby removing the voltage deviation of the pixel electrodes 1. Thus, the above-identified problem about brightness unevenness can be solved. This means that the image quality is improved.

Also, because the basic configuration of the LCD according to the first embodiment is the same as that of the conventional one shown in FIGS. 2 and 3, the fabrication cost of a data driver circuit is suppressed.

Additionally, the pixels 1 may be driven by another method as shown in FIGS. 12A to 12G. This method is substantially the same as the driving method shown in FIGS. 11A to 11G except for the following difference.

The data signals D(j) and D(j−1) are kept at the same level during the whole scanning period TH in the driving method shown in FIGS. 11A to 11G. On the other hand. in the driving method shown in FIGS. 12A to 12G, the data signals D(j) and D(j−1) are turned from a level to another at the intermediate time T2 of the scanning period TH. In other words, the data signals D(j) and D(j−1) are kept at a low (or, high) level during the earlier scanning period TH1 and at a high (or, low) level during the later scanning period TH2.

SECOND EMBODIMENT

Figure 13:
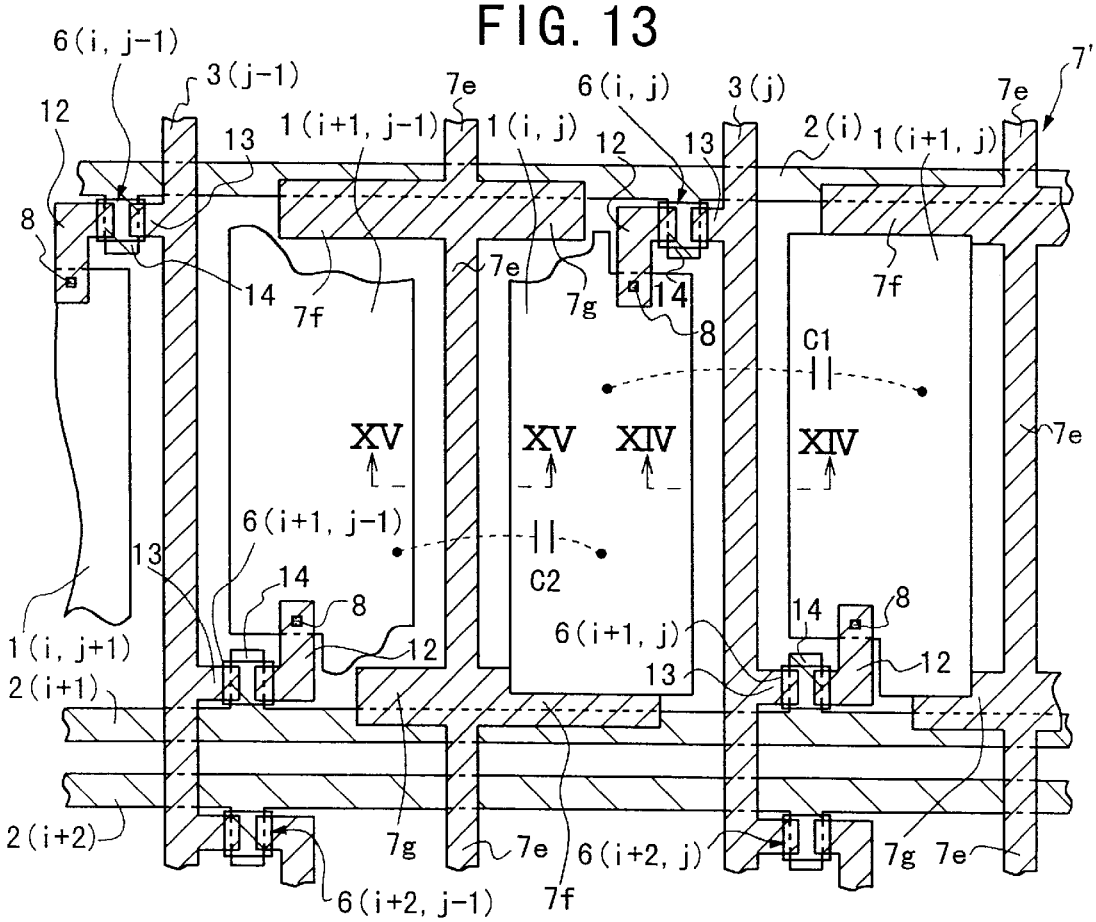
FIG. 13 is a partial, enlarged plan view of a part of the conf iguration of a color LCD according to a second embodiment of the present invention.
Figure 14:
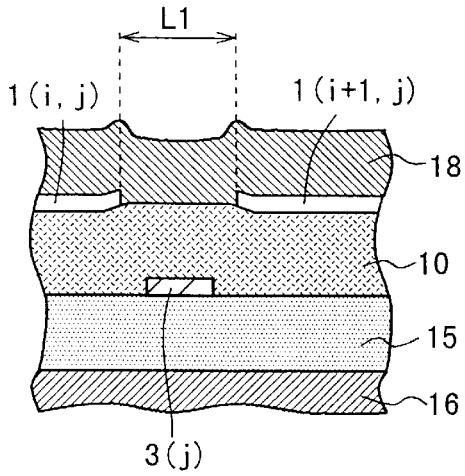
FIG. 14 is a partial, cross-sectional view of the LCD according to the second embodiment, which is along the line XIV—XIV in FIG. 13.
Figure 15:
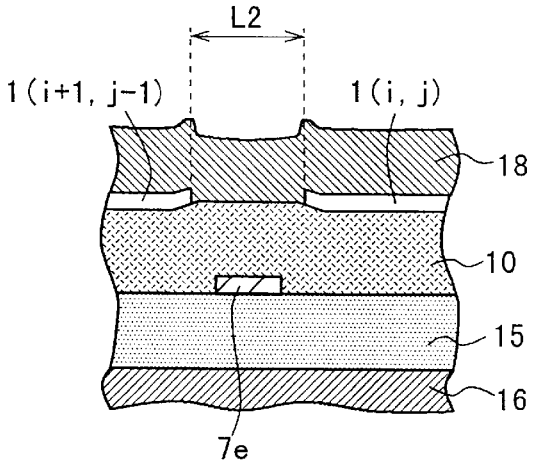
FIG. 15 is a partial, cross-sectional view of the LCD according to the second embodiment, which is along the line XV—XV in FIG. 13.

FIGS. 13, 14, and 15 show a color LCD according to a second embodiment. This LCD has the same configuration as that of the first embodiment other than the pattern and structure of the fixed-potential electrodes. Therefore, the explanation about the same configuration is omitted here by attaching the same reference numerals or characters to the same and corresponding elements in FIGS. 13, 14, and 15 for the sake of simplification of description.

As shown in FIGS. 13, 14, and 15, an electrically conductive film 7' is formed on the gate insulating film 15, not on the glass substrate 16. The pixel electrodes 1 are formed on the protection film 10. A passivation film 18 is formed on the film 10 to cover all the pixel electrodes 1.

The pixel electrodes 1 are electrically connected to the source electrodes 12 of the corresponding TFTs 6 through corresponding contact holes 8 formed In the passivation film 10.

The conductive film 7' has a pattern as clearly shown in FIG. 13. This conductive film 7' defines fixed-potential electrodes 7*e* to which a fixed electric potential is applied on operation. Each of the fixed-potential electrodes 7*e* has a linear plan shape extending along the data lines 3(1) to 3(3n/2). Two adjoining ones of the electrodes 7*e* are separated from each other.

Two light-shielding parts 7*f* and two light-shielding parts 7*g* are protruding from the opposite sides of each fixed-potential electrode 7*e* along the scanning lines 2(1) to 2(2m). The light-shielding parts 7*f* and 7*g* are located at the positions between the pixel electrodes and the corresponding scanning lines 2(1) to 2(2m) to be overlapped with the scanning lines 2(1) to 2(2m) and the pixel electrodes 1. These parts 7*f* and 7*g* serve as light shielding members.

The electrically conductive film 7' for the fixed-potential electrodes 7*e* and the light-shielding parts 7*f* and 7*g* is the same as an electrically conductive film used for forming the data lines 3 and the source and drain electrodes 12 And 13 of the TFTs 6. Therefore, the fixed-potential electrodes 7*e* and the light-shielding parts 7*f* and 7*g* may be formed in the same process step as that of the data lines 3(1) to 3(3n/2) and the source and drain electrodes 12 and 13.

As shown in FIGS. 14 and 15, the fixed-potential electrode 7*e* is not overlapped with the underlying pixel electrode 1(i, j) or 1(i+1, j). Each fixed-potential electrode 7*e* is located at the middle of these two pixel electrode 1(i, j) or 1(i+1, j).

The fixed-potential electrode 7*e* and the data line 3(j) are the same in position and size. The cross section of FIG. 14 is symmetric with that of FIG. 15. Accordingly, there is an additional advantage that the capacitance of the parasitic capacitors C1 and C2 can be readily designed to be canceled completely, in addition to the same advantages as those in the first embodiment.

Also, since the conductive film 7' has the light-shielding parts 7*f* and 7*g*, there is another additional advantage that the aperture ratio can be increased compared with the LCD according to the first embodiment.

THIRD EMBODIMENT

Figure 16:
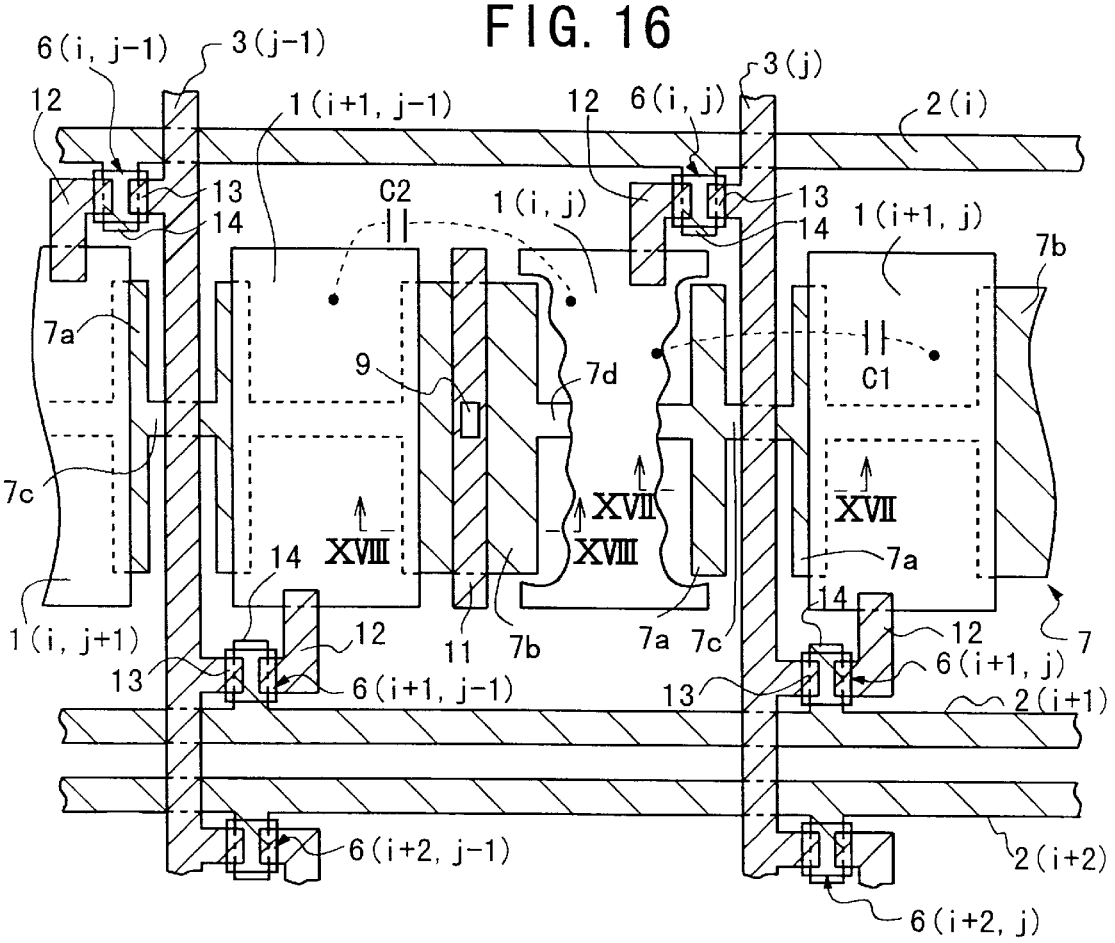
FIG. 16 is a partial, enlarged plan view of a part of the configuration of a color LCD according to a third embodiment of the present invention.
Figure 17:
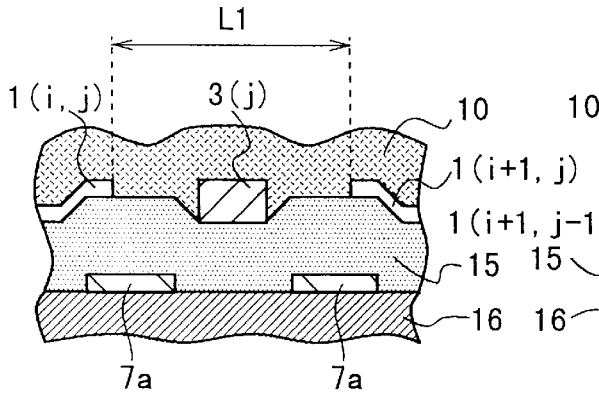
FIG. 17 is a partial, cross-sectional view of the LCD according to the third embodiment, which is along the line XVII—XVII in FIG. 16.
Figure 18:
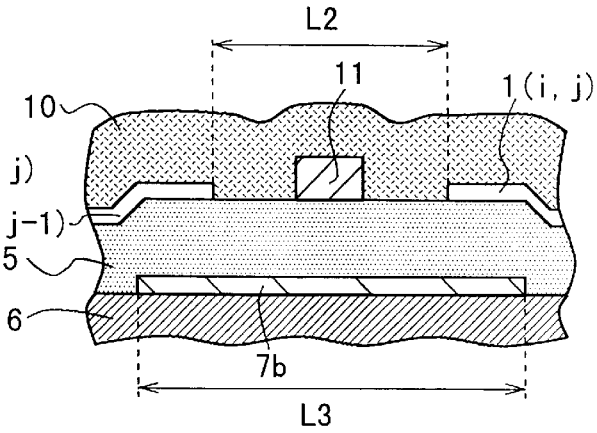
FIG. 18 is a partial, cross-sectional view of the LCD according to the third embodiment, which is along the line XVIII—XVIII in FIG. 16.
Figure 19:
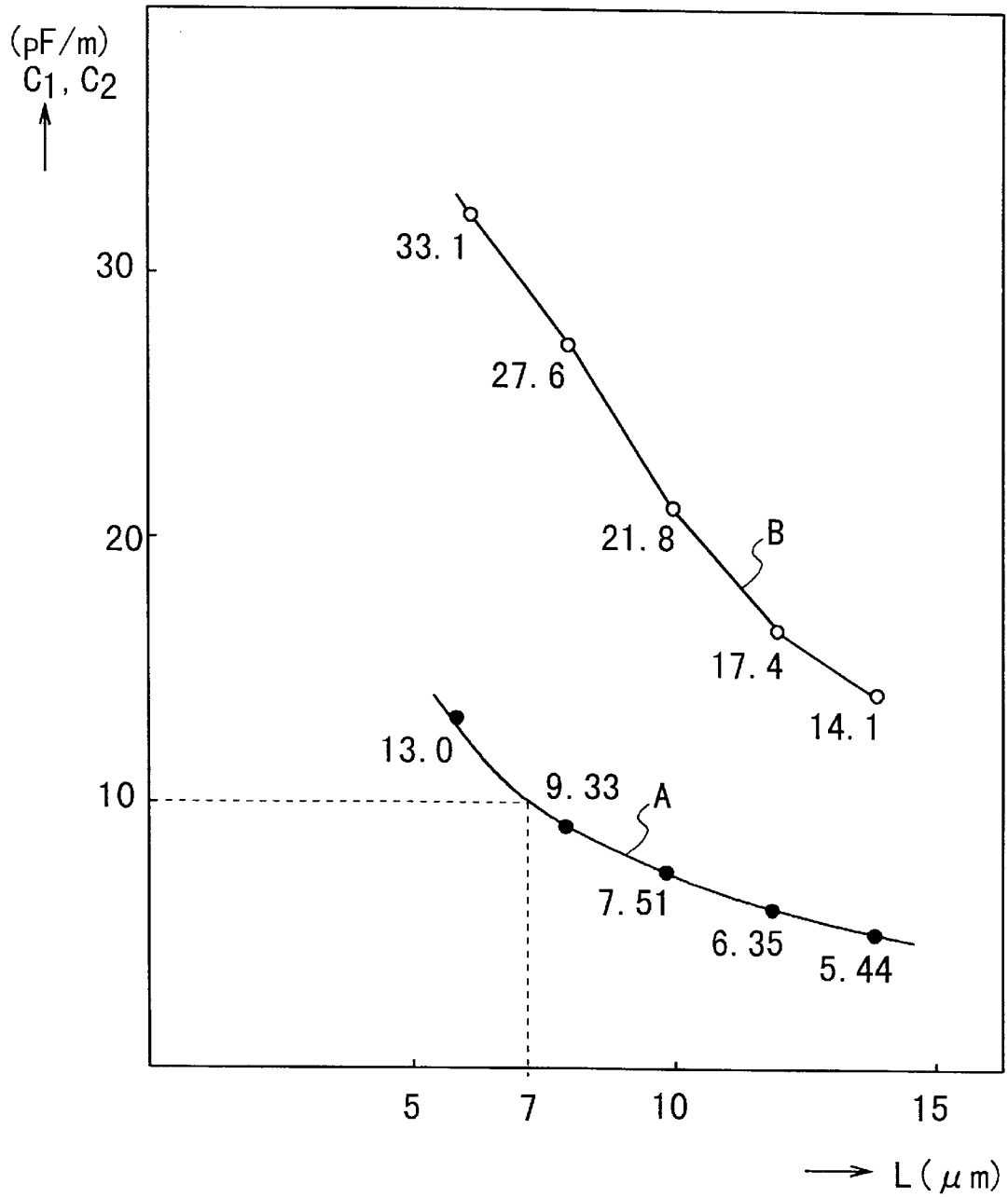
FIG. 19 is a graph showing the relationship of the parasitic capacitances $C_1$ and $C_2$ with the length L between the opposing ends of the pixel electrodes.

FIGS. 16, 17, and 18 show a color LCD according to a third embodiment. This LCD has a configuration obtained by adding another fixed-potential electrodes 11 to the LCD according to the first embodiment. Therefore, the explanation about the same configuration is omitted here by attaching the same reference numerals or characters to the same and corresponding elements in FIGS. 16, 17. and 18 for the sake of simplification of description.

As shown in FIGS. 16, 17, and 18, the fixed-potential electrodes 11 is formed on the gate insulating film 15, not on the glass substrate 16. The pixel electrodes 1 are formed on the same gate insulating film 15.

Each of the fixed-potential electrodes 11. which has a linear plan shape extending along the data lines 3(1) to 3(3n/2), is located at the center of the corresponding fixed-potential electrode 7*b*. Each of the fixed-potential electrodes 11 is electrically connected to the underlying, corresponding fixed-potential electrode 7*b* through a contact hole 9 formed in the gate insulating film 15.

The fixed-potential electrodes 11 may be formed by patterning an electrically conductive film for the data lines 3(1) to 3(3n/2) in the same process.

As shown in FIGS. 17 and 18, the fixed-potential electrode 11 and the data line 3(j) are the same in relative position and size. The cross section of FIG. 17 is approximately symmetric with that of FIG. 18. Accordingly, there is an additional advantage that the capacitance of the parasitic capacitors C1 and C2 can be readily designed to be canceled completely, in addition to the same advantages as those in the first embodiment.

Also, since the combination of the fixed-potential electrodes 7*b* and 11 forms an electric-field shielding structure, the capacitances of the parasitic capacitors C1 and C2 scarcely vary dependent on the distances L1 and L2. As a result, the distances from the pixel electrodes 1 and the data lines 2 or scanning lines 3 are decreased due to the electric-field shielding structure.

Although the present invention is applied to color LCDs in the above-described first to third embodiments, it is needless to say that the invention may be applied to monochrome LCDs.

While the preferred forms of the present invention has been described, it is to be understood that modifications will be apparent to those skilled in the art without departing from the spirit of the invention. The scope of the invention, therefore, is to be determined solely by the following claims.

What is claimed is:

1. A liquid-crystal display comprising:

(a) a first plurality of pixel electrodes arranged in a matrix array having rows and columns;

(b) a second plurality of pixel electrodes arranged along said rows and columns of said matrix array;

(c) a first plurality of scanning lines arranged along said respective rows of said matrix array;

(d) a second plurality of scanning lines arranged along said respective rows of said matrix arrays;

(e) date lines arranged along said respective columns of said matrix array;

(f) thin-film transistors arranged at respective intersections of said first and second pluralities of scanning lines with said data lines;

(g) a first plurality of fixed-potential electrodes; and (h) a second plurality of fixed-potential electrodes;

wherein each of said first plurality of pixel electrodes and a corresponding one of said second plurality of pixel electrodes are located at each side of a corresponding one of said data lines, forming an electrode pair;

and wherein each of said first plurality of said scanning lines is used for supplying a first scanning signal to corresponding ones of said first plurality of pixel electrodes included in a corresponding one of said rows of said matrix array through corresponding ones of said TFTs during a first scanning subperiod of a predetermined scanning period;

and wherein each of said second plurality of said scanning lines is used for supplying a second scanning signal to corresponding ones of said second plurality of pixel electrodes included in a corresponding one of said rows of said matrix array through corresponding ones of said transistors during a second scanning subperiod of said scanning period subsequent to said first scanning subperiod;

and wherein each of said data lines is commonly used for supplying a data signal to corresponding ones of said electrode pairs included in a corresponding one of said columns of said matrix array through corresponding ones of said TFTs;

and wherein each of said first plurality of fixed-potential electrodes is located between one of said first plurality of pixel electrodes and a corresponding one of said second pluralities of pixel electrodes that form one of said electrode pairs;

and wherein each of said second plurality of fixed-potential electrodes is located between one of said first plurality of pixel electrodes and an adjoining one of said second plurality of pixel electrodes that are included in different ones of said electrode pairs;

and wherein said first and second pluralities of fixed-potential electrodes are designed to be applied with a fixed electric potential on operation.

2. A liquid-crystal display as claimed in claim 1, wherein said first and second pluralities of fixed-potential electrodes serve to increase a storage capacitance of said pixel electrodes.

3. A liquid-crystal display as claimed in claim 1, wherein said first and second pluralities of fixed-potential electrodes are located in a same level as that of gate electrodes of said transistors.

4. A liquid-crystal display as claimed in claim 1, wherein said first and second pluralities of fixed-potential electrodes are located in a same level as that of gate electrodes of said transistors;

and wherein said first and second pluralities of pixel electrodes are formed over said transistors through an insulating film;

and wherein source or drain electrodes of said transistors are electrically connected to said first and second pluralities of fixed-potential electrodes through contact holes of said insulating film, respectively.

5. A liquid-crystal display as claimed in claim 1, wherein said first and second pluralities of fixed-potential electrodes serve to light-shielding members.

6. A liquid-crystal display as claimed in claim 1, wherein a part of said first and second pluralities of fixed-potential electrodes are located in a same level as that of said data lines and said remaining first and second pluralities of fixed-potential electrodesa are located in a same level as that of gate electrodes of said transistors;

and wherein said part of said first and second pluralities of fixed-potential electrodes are electrically connected to said remaining first and second pluralities of fixed-potential electrodes through contact holes of a gate insulating film, respectively.

* * * * *

UNITED STATES PATENT AND TRADEMARK OFFICE

CERTIFICATE OF CORRECTION

PATENT NO. : 6,028,577

DATED : February 22, 2000

INVENTOR(S) : Sakamoto

It is certified that error appears in the above-identified patent and that said Letters Patent are hereby corrected as shown below:

Claim 1, Col. 17, line 23, "arrays" should be --array--.
Claim 1, Col. 17, line 24, "date" should be --data--.
Claim 6, Col. 18, line 45, "electrodesa" should be --electrodes--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*